US011254403B2

(12) United States Patent
Vignola

(10) Patent No.: US 11,254,403 B2
(45) Date of Patent: Feb. 22, 2022

(54) SALVAGE SUIT FOR SHIPWRECKS WITH HIGH FUNCTIONALITY AND INSULATION

(71) Applicant: Mario Cesar Vignola, Buenos Aires (AR)

(72) Inventor: Mario Cesar Vignola, Buenos Aires (AR)

( * ) Notice: Subject to any disclaimer, the term of this patent is extended or adjusted under 35 U.S.C. 154(b) by 374 days.

(21) Appl. No.: 16/315,375

(22) PCT Filed: Apr. 21, 2017

(86) PCT No.: PCT/IB2017/052299

§ 371 (c)(1),
(2) Date: Jan. 4, 2019

(87) PCT Pub. No.: WO2018/007876

PCT Pub. Date: Jan. 11, 2018

(65) Prior Publication Data

US 2019/0308700 A1 Oct. 10, 2019

(30) Foreign Application Priority Data

Jul. 7, 2016 (AR) ..... 20160102088
Jul. 7, 2016 (AR) ..... 20160102089

(51) Int. Cl.
*B63C 9/087* (2006.01)

(52) U.S. Cl.
CPC ..... *B63C 9/087* (2013.01)

(58) Field of Classification Search
CPC ..... B63C 9/087; B63C 9/093; B63C 9/105; B63C 9/1055
See application file for complete search history.

(56) References Cited

U.S. PATENT DOCUMENTS 1,851,100 A * 3/1932 Ilg ..... B63C 9/093 441/105
3,369,263 A * 2/1968 Kreckl ..... B63C 11/04 441/104
3,911,913 A * 10/1975 June ..... A44B 19/16 128/201.29
4,881,539 A * 11/1989 Pasternack ..... A41D 13/0025 128/201.27

FOREIGN PATENT DOCUMENTS

GB 104452 A * 3/1917 ..... B63C 9/093

* cited by examiner

*Primary Examiner* — Andrew Polay
(74) *Attorney, Agent, or Firm* — Noli IP Solutions PC

(57) ABSTRACT

This suit (1) includes an access opening (30) to the inner cavity or receptacle (10) and a facial opening (50) that are independent; around the facial opening (50), the structure of insulation walls (2) includes a hood (5) and both openings (30, 50), access (30) and facial (50), surrounded by a unfoldable sleeve (4) that is projected from the structure of insulation walls (2); the outer cover of protection includes a headpiece cover (7) that covers the hood (5) and a body cover (6) that are separated by a surrounding passage (9) through which the unfoldable sleeve (4) is capable of unfolding, until forming an environmental protection over said hood (5) and over said access opening (30).

32 Claims, 26 Drawing Sheets

B

A

SALVAGE SUIT FOR SHIPWRECKS WITH HIGH FUNCTIONALITY AND INSULATION

TECHNICAL FIELD OF THE INVENTION

The present invention refers to the field of the different industrial techniques and to the transports such as vessels and, referring to this, to rescue equipment at the sea or other aquatic environments.

In particular, this invention refers to a salvage suit for shipwrecks with high functionality and insulation that allows using walls of high thermal isolation without this affecting the access of the shipwreck survivor into the suit and his mobility within it, thereby making the access and exit opening independent from the facial opening, keeping both openings within the limits of protection of an unfoldable sleeve that is unfolded through a passage of the outer cover, all this complemented by a suitable headpiece fixing and great mobility in the rest of the suit.

The problem at the basis of the present invention is to overcome the problem of the difficulty of effecting the movements of entry through the openings and quick placement of salvage suits with thick insulation walls, as well as the lack of protection around said openings of said salvage suits, of the already known salvage suits.

The problem is solved with a salvage suit according claim 1.

Background of the Invention

None of the known salvage suits has an access opening that, together with the inner hood, is within the protection area in which the unfoldable sleeve acts that, upon unfolding, protects both the facial opening of the hood and the access opening.

The present suit has an access opening to the inner cavity of the suit that is arranged in the rear part of the suit, facilitating both the access and the exit of said inner cavity. It allows the shipwrecked person entering into the suit quicker, as he is dressed, and this action is not hindered by the clothes or shoes that he is wearing. The suit can be worn quicker, and so the shipwrecked ship evacuation can be made quicker.

The mentioned access opening, together with the inner hood, is within the protection area in which the unfoldable sleeve acts that, upon unfolding, protects both the facial opening of the hood and the access opening.

In an embodiment, the access opening to the inner cavity of the suit is arranged in a front protrusion that allows a great opening of said access opening.

As the receptacle is spacious, different movements can be made inside the suit. For example: take the legs out of the suit legs toward the main part of the suit, take the arms out of the sleeves, change the different floating positions in order to be more comfortable, etc.

The structure of the insulating walls, preferably based on alveolar layers, not only allows a proper thermal insulation and a greater buoyancy capacity, but also allows a sectorial differentiation of its walls. This sectorial differentiation (micro-alveolar areas, macro-alveolar areas, areas with different density alveoli, etc.) allows achieving a differential sectorial insulation and a differential sectorial functionality (for example: micro-alveolar areas where a greater mobility or flexibility is required).

The capacity of flotation given by the alveolar sheets, the hermetic chambers and the body receptacle keep the suit almost completely out of the water, and this diminishes the area of body contact with the water and prevents the body from being exposed to cold, when the water temperature is low.

This suit allows flotation with almost the whole body out of the water, and this allows swimming on one's back or on one's chest very easily (and so it is easy to face even opposite wind and/or current), being the additional advantage that, in case of a puncture, tearing or flooding, the suit inner bladder is not lost, as we also have the alveolar layers, the hermetic chambers and the body receptacle air.

The differential sectorial functionality is also increased with the presence of joint folds.

On the other hand, the incorporation of separated headpiece outer cover and body outer cover, maintains a surrounding passage free through which the unfolding of the unfoldable sleeve is produced. Furthermore, said body cover can include drainage passages to prevent the accumulation of water inside it, hindering user's movements.

At the same time, the wearer protects his face, neck, hands and arms, he has a 100% hermetic barrier against water, and he gets an adequate protection against hypothermia. Consequently, the wearer can stay longer in cold water.

BRIEF DESCRIPTION OF THE DRAWINGS

In the interest of clarity and ease of understanding of the object of the invention, it is illustrated with several figures in which it has been represented in one of its preferred embodiments, all this for illustration purposes only, but not limited to it.

Figure 1:
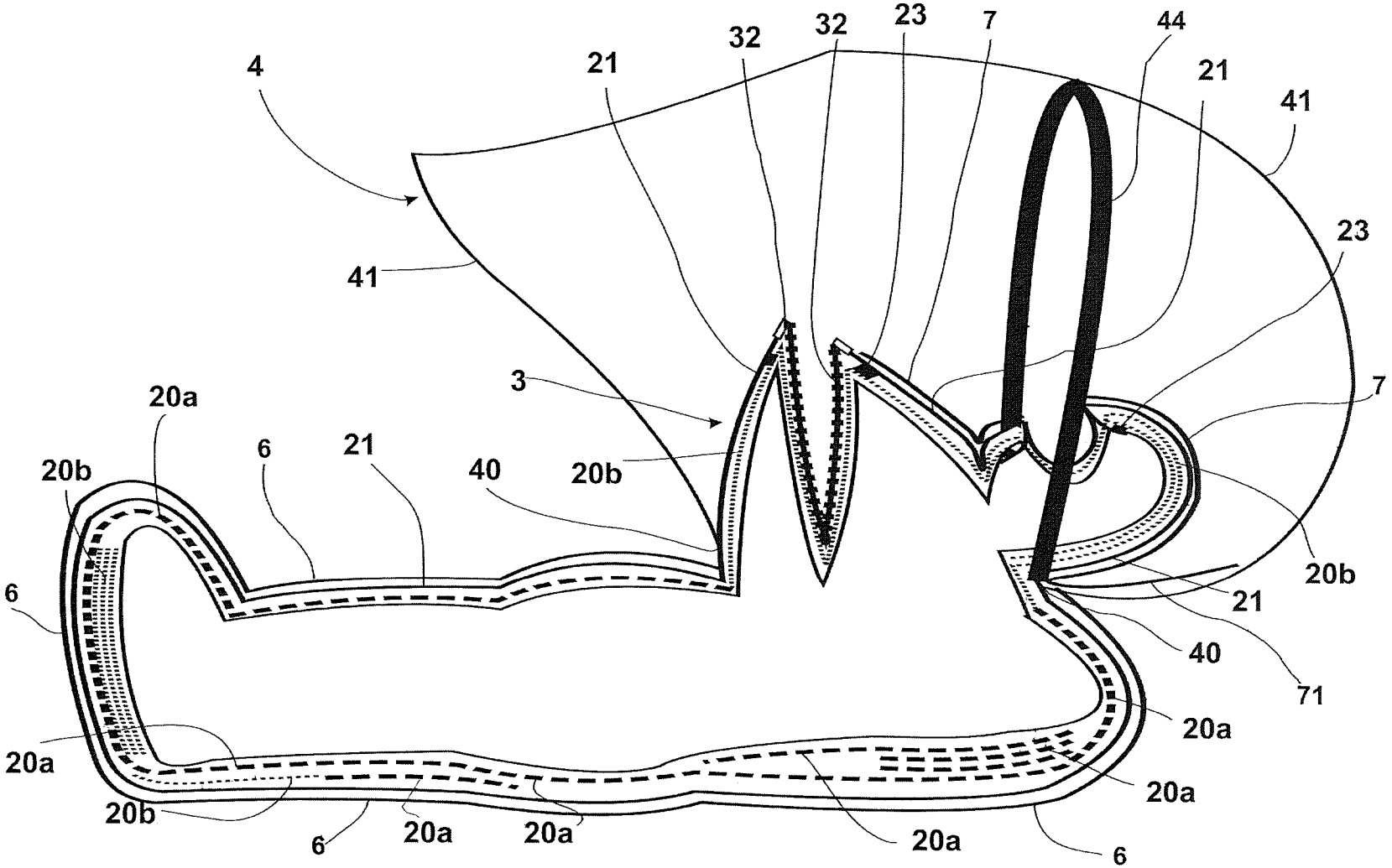
FIG. 1 is a schematic representation of a longitudinal cut of the suit, with the outer cover, in which the different components of the structure of insulating walls are shown, in one of its possible embodiments.
Figure 2:
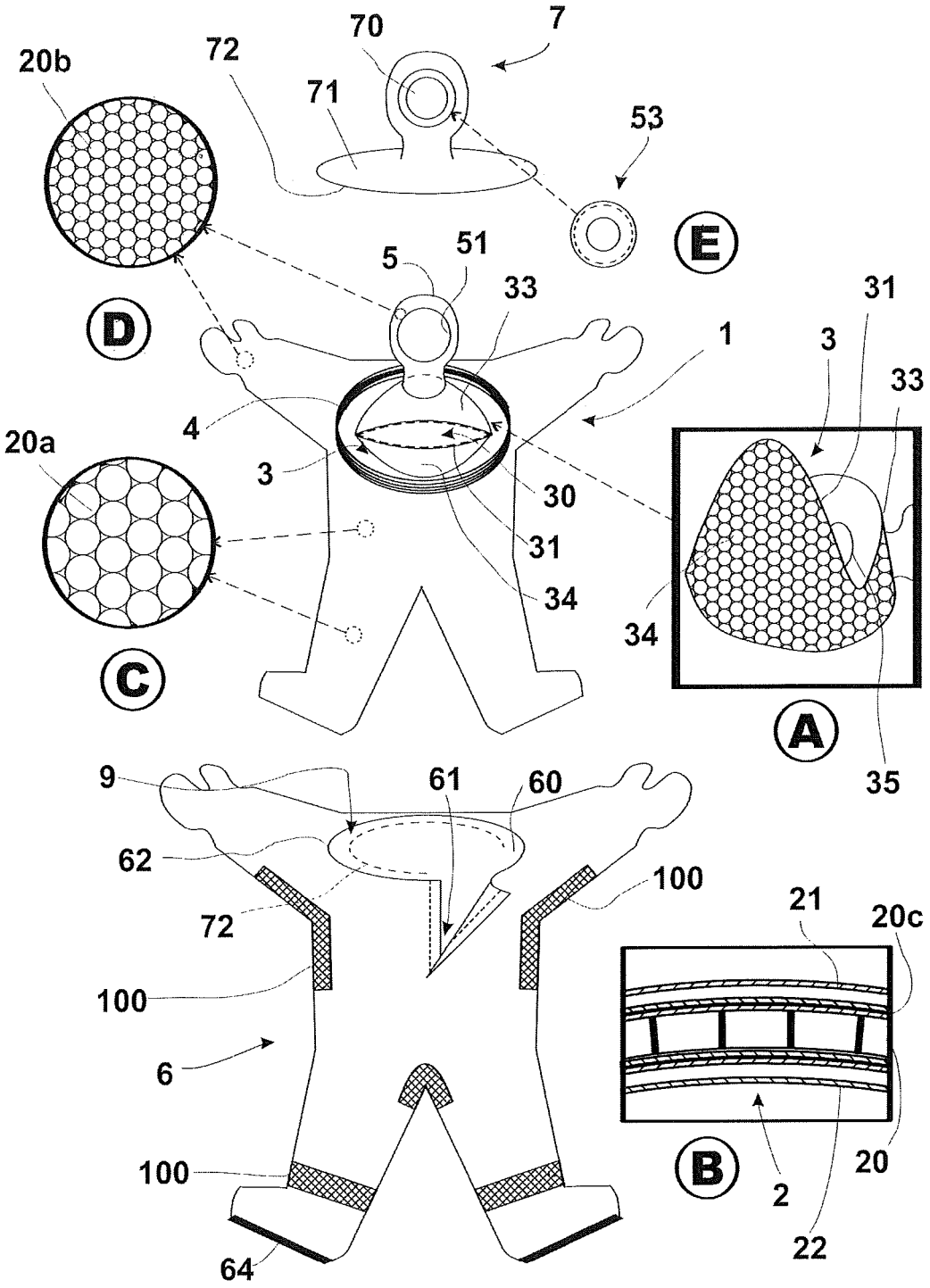
FIG. 2 is a front view, in elevation, of present suit. In the upper part, the headpiece outer cover is shown, while in the lower part, the outer body cover is shown.

Furthermore, FIG. 2 includes details in drawings A, B, C, D and E, being:

Drawing A, a perspective view of the front protrusion;

Drawing B, a transversal cut of one alveolar wall that shows its constitution;

Drawing C, a detail of a wall with macro-alveolar structure;

Drawing D, a detail of a wall with micro-alveolar structure; and

Drawing E, a detail of the hermetic frame of the headpiece outer cover.

Figure 3:
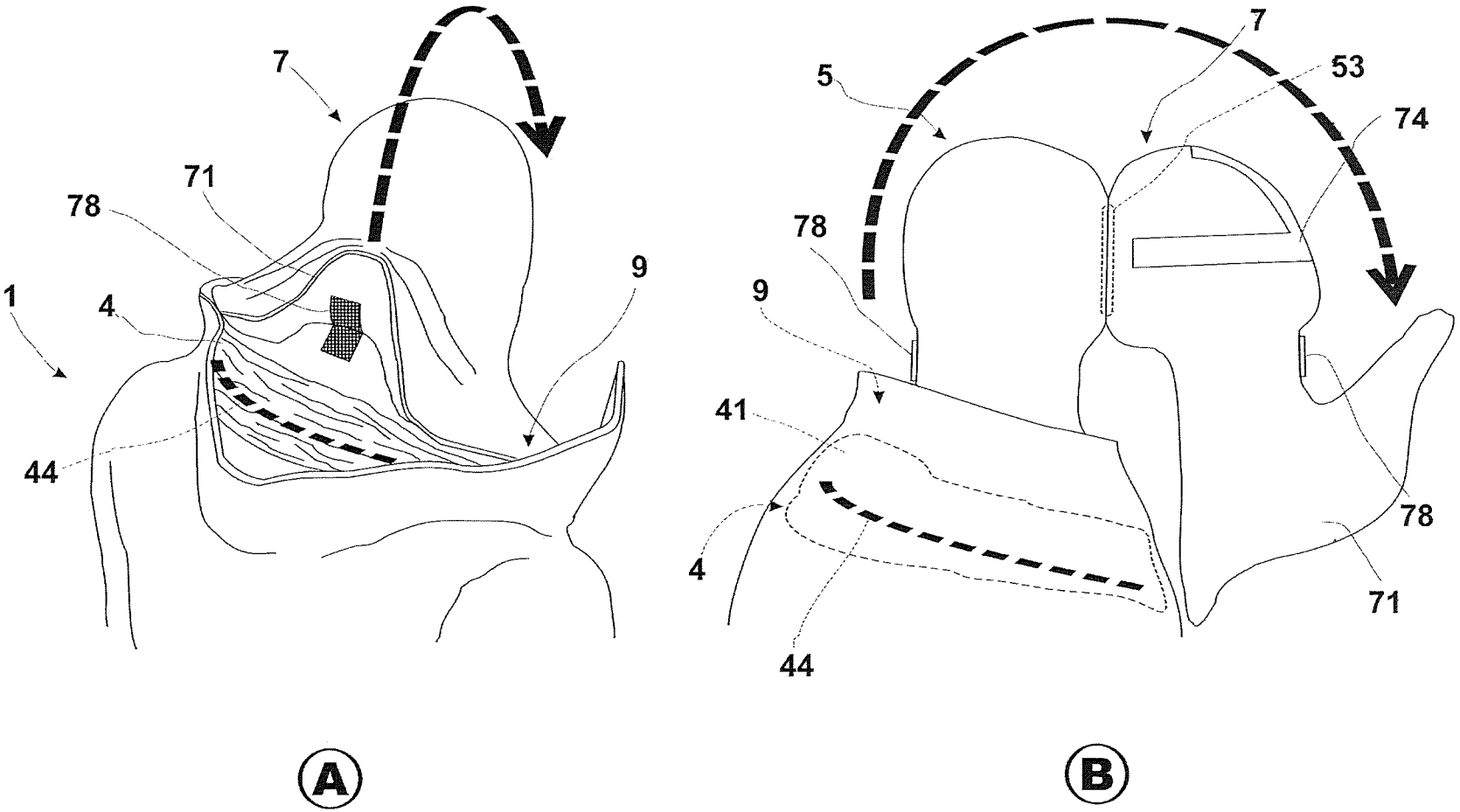

FIG. 3 includes drawings A and B, being:

Drawing A, a perspective rear view of the upper part of the suit, in which the release of the fixing is shown which, in this embodiment, links the outer headpiece cover with the suit structure and Drawing B, a side view that shows the removal of the outer headpiece cover leaving the headpiece hood exposed. In the inner part of said headpiece cover the traction arrangement can be seen.

Figure 4:
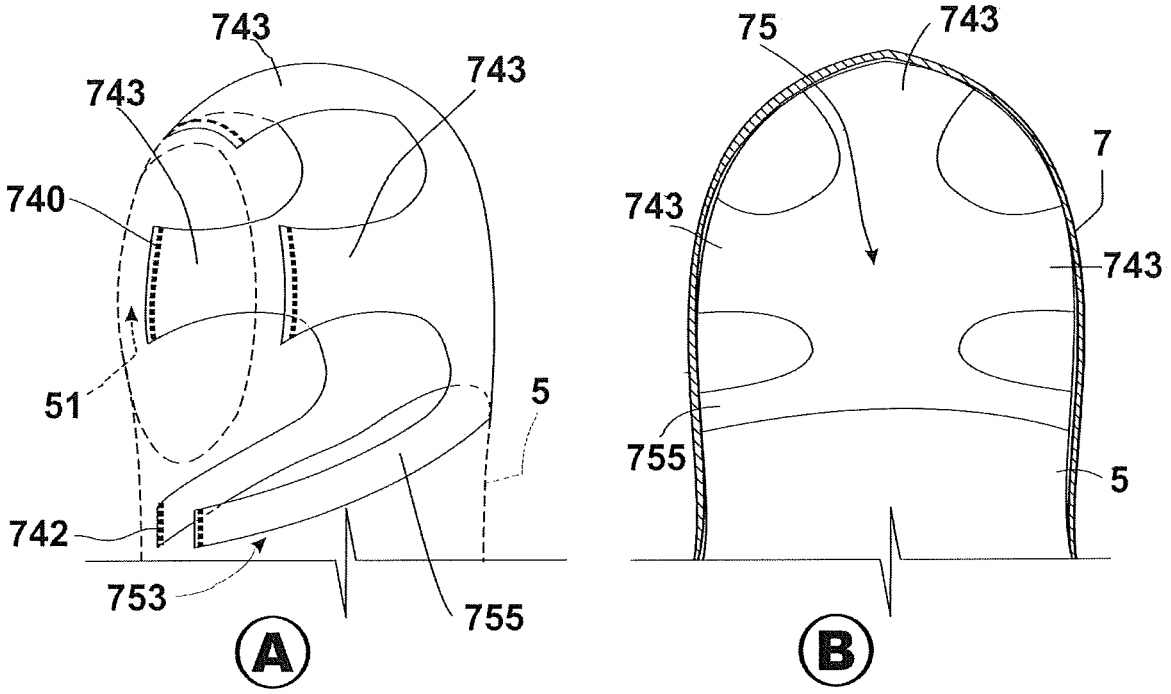

FIG. 4 includes drawings A and B, being:

Drawing A, a perspective view of present adjustment system, illustrating with dashed lines the hood over which inner part the system is mounted. In this case, this refers to another variation of elastic adjustment through members of elastic walls, and Drawing B, a transversal cut of the outer hood that allows the observation of a rear view of the present system, in elevation. As can be appreciated, it is the same variation as drawing A.

Figure 5:
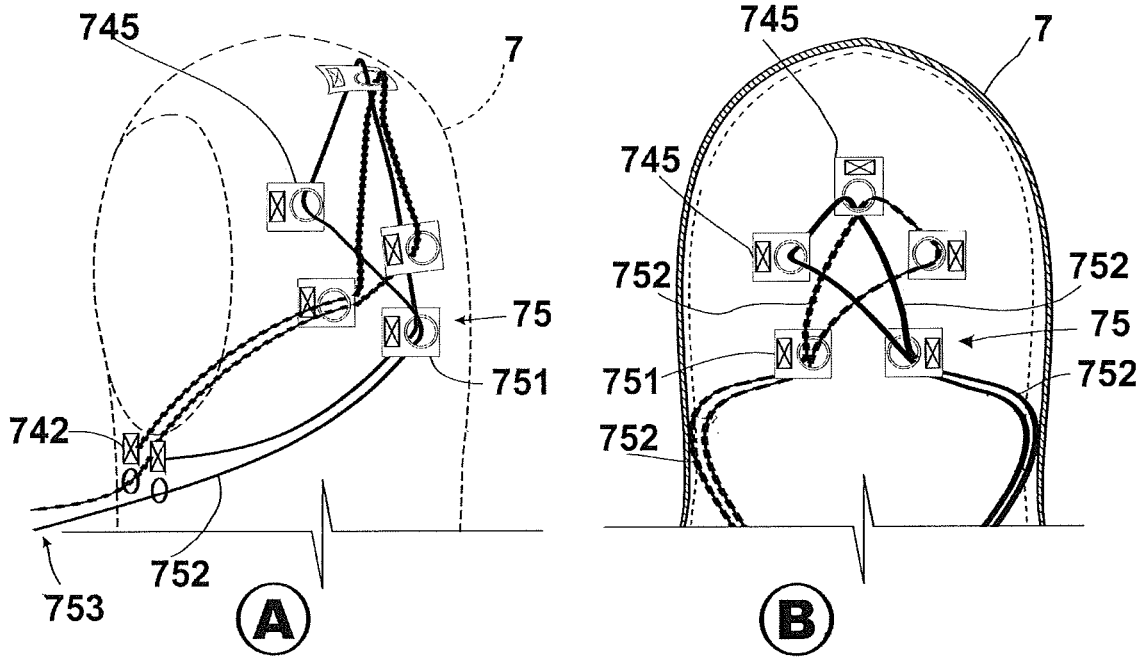

FIG. 5 includes the drawings A and B, being:

Drawing A, a perspective view of present adjustment system, illustrating with dashed lines the hood over which inner part the system is mounted. In this case, it is the variation with a traction device based on rear fixed linepull connections of manual adjustment and Drawing B, a transversal cut of the outer hood that allows the observation of the system of drawing A in a rear view, in elevation. The position of the inner hood is shown with dashed lines.

Figure 6:
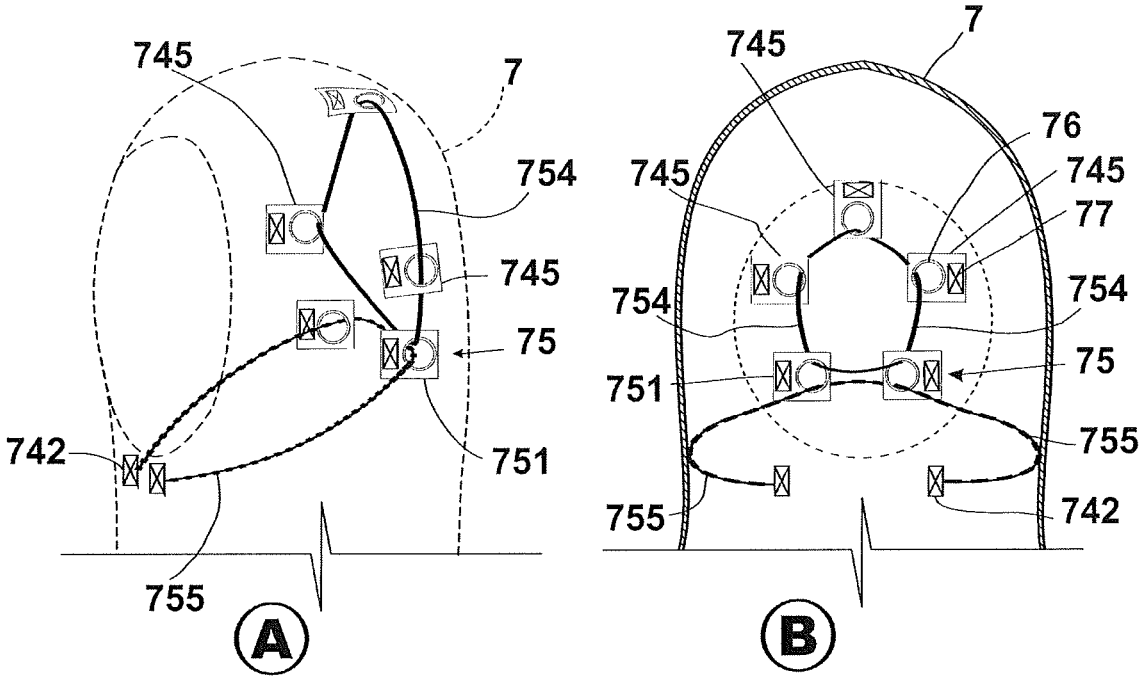

FIG. 6 includes drawings A and B, being:

Drawing A, a perspective view of the present adjustment system, illustrating with dashed lines the hood over which inner part the system is mounted. In this case, it is a traction device based on rear fixed linepull connections with elastic adjustment through elastic strips and Drawing B, a transversal cut of the outer hood that allows the observation of the present system in a front view, in elevation. It can be appreciated how the side adjustment strips have the corresponding front fixed links, in the front part underneath the facial opening of the outer hood.

Figure 7:
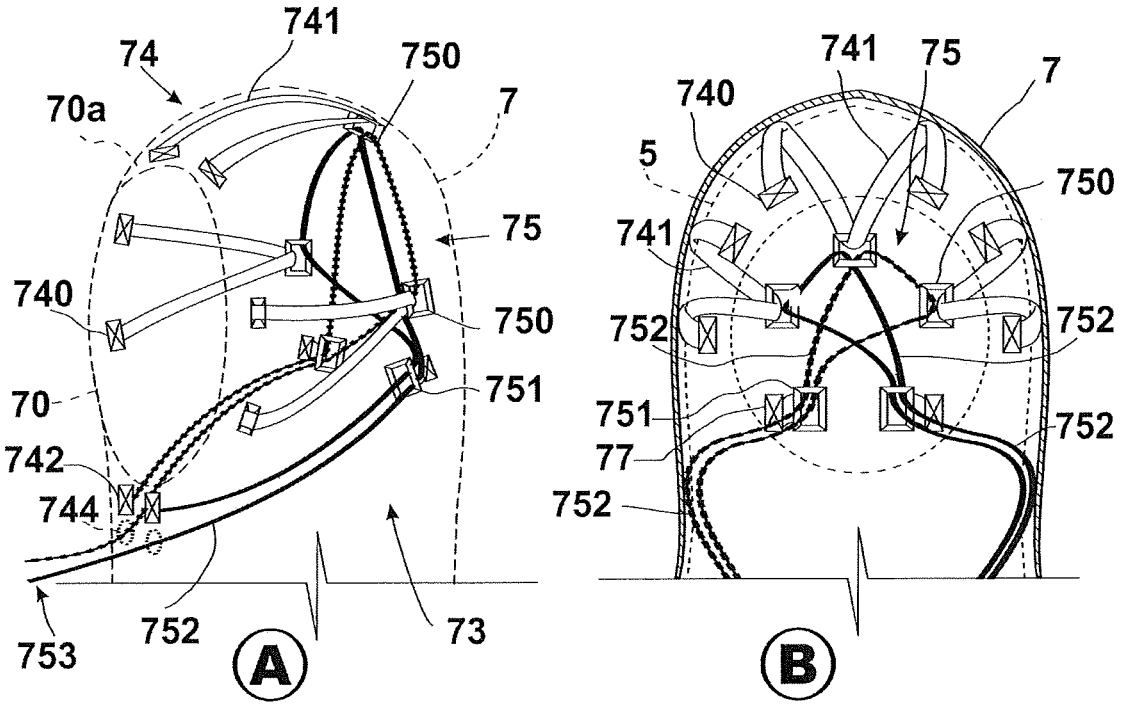

FIG. 7 includes drawings A and B, being:

Drawing A, a perspective view of present adjustment system, illustrating with dashed lines the hood over which inner part the system is mounted. In this case it is a manual adjustment variation and Drawing B, a transversal cut of the outer hood that allows the observation of the present system in a front view, in elevation. The position of the inner hood is shown with dashed lines.

Figure 8:
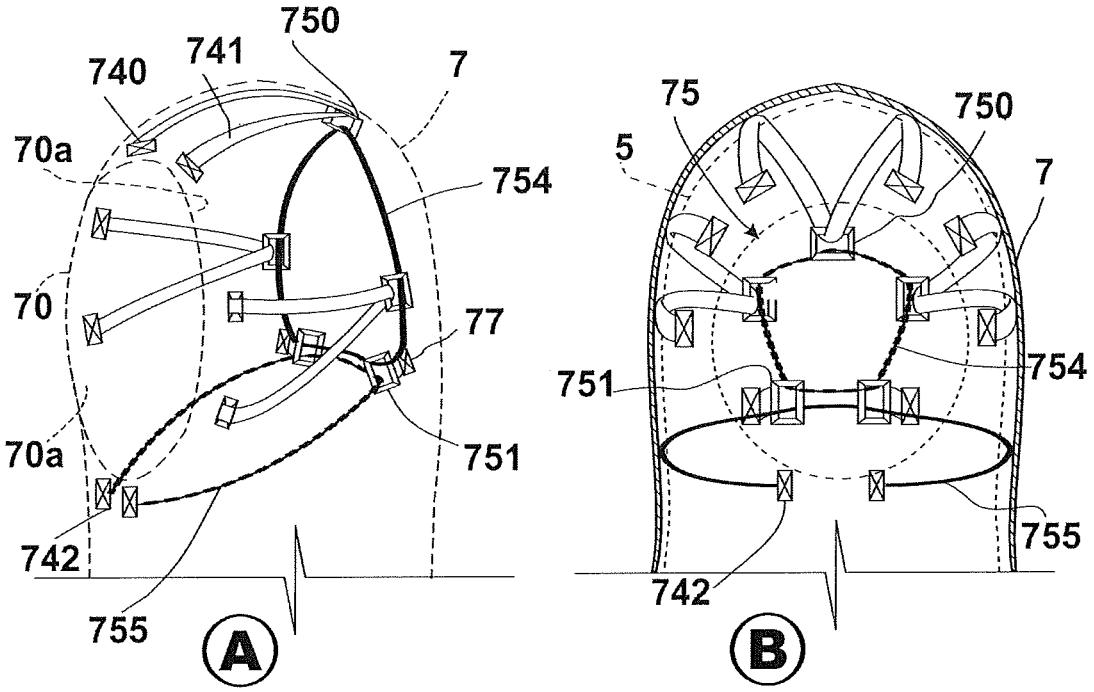

FIG. 8 includes drawings A and B, being:

Drawing A, a perspective view of present adjustment system, illustrating with dashed lines the hoods over which inner part the system is mounted. In this case, it is one of the variations of elastic adjustment through elastic strips and Drawing B, a transversal cut of the outer hood that allows the observation of the present system in a front view, in elevation. It can be appreciated how the side adjustment strips have the corresponding front fixed links, in the front part underneath the facial opening of the outer hood.

Figure 9:
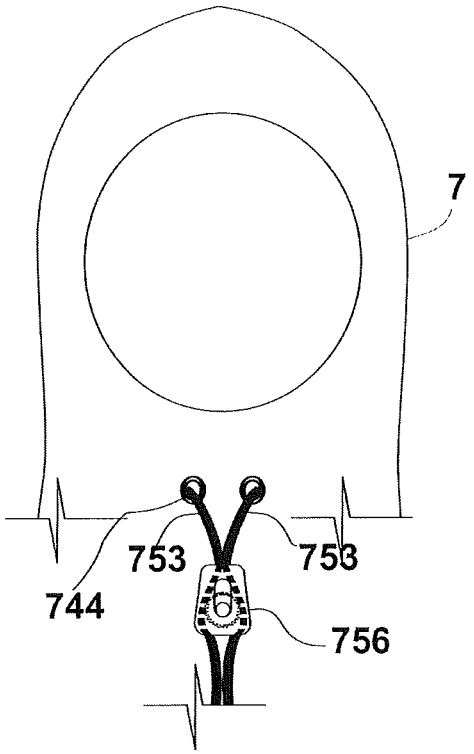

FIG. 9 is a front view, in elevation of the hood in which the presence of a positional lock is shown that, after producing the stretching, prevents the loosening of the adjustment system.

Figure 10:
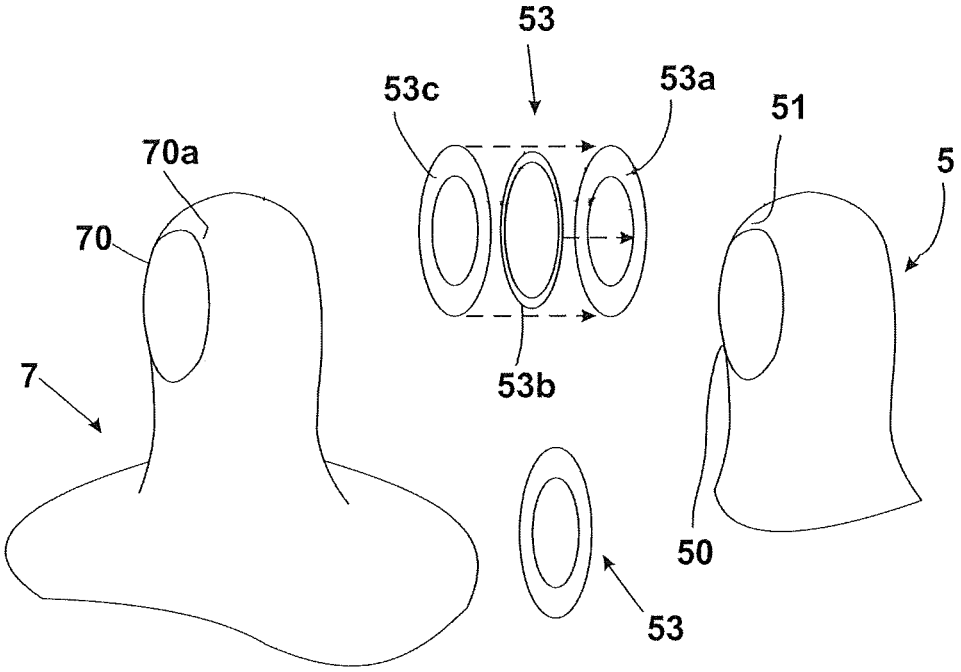

FIG. 10 is an exploded perspective view in which, apart from the outer cover hood and the inner hood, a disassembly of the main components of the hermetic structure can be seen, where the arrows indicate the overlapping union of said components. Underneath said disassembling the assembled hermetic structure is shown.

Figure 11:
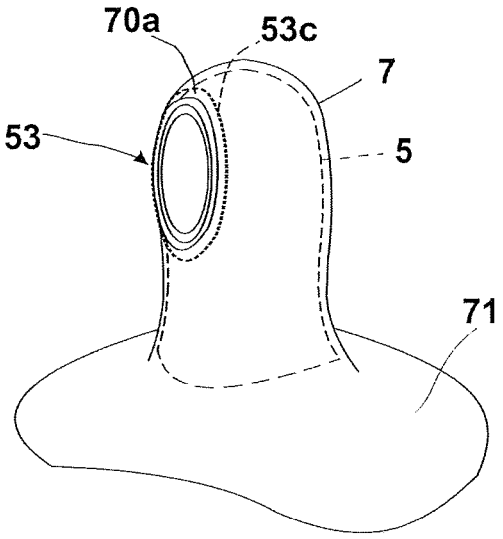

FIG. 11 is a perspective view in which the hermetic structure is fixed around both facial openings of both hoods: outer headpiece cover and inner hood.

Figure 12:
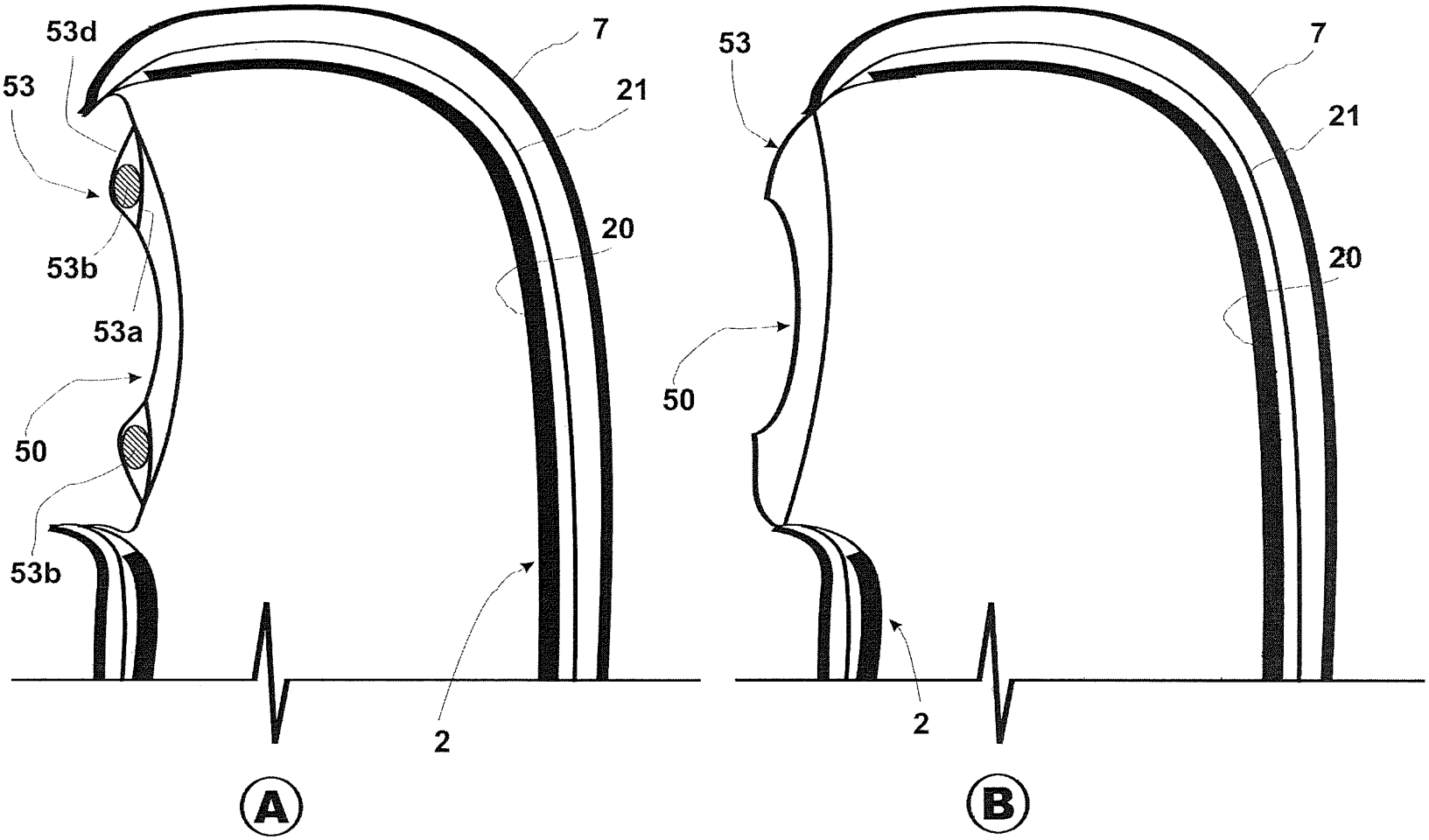

FIG. 12 includes drawings A and B, being:

Drawing A, a longitudinal cut of the upper part of the suit in which the different walls that form the structure can be seen. In this embodiment, the facial hermetic frame structure includes a filling wall and Drawing B, a longitudinal cut of the upper part of the suit in another embodiment in which the facial hermetic frame structure lacks of filling wall.

Figure 13:
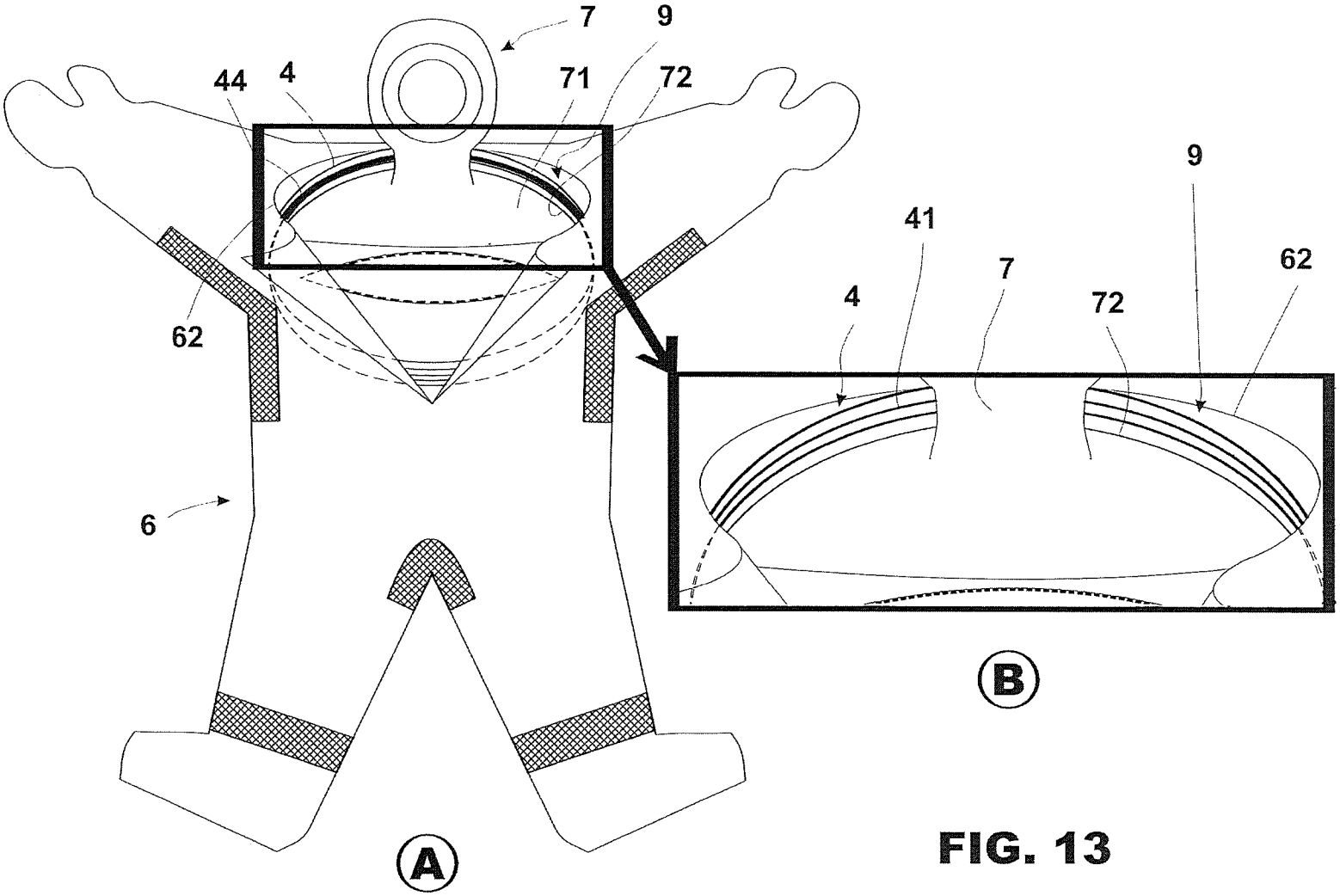

FIG. 13 includes drawings A and B, being:

Drawing A, a front view, in elevation of the suit with the outer cover and

Drawing B, a detail in which the surrounding passage existing between the headpiece outer cover and the body outer cover, through which the unfolding of the unfoldable sleeve is produced.

Figure 14:
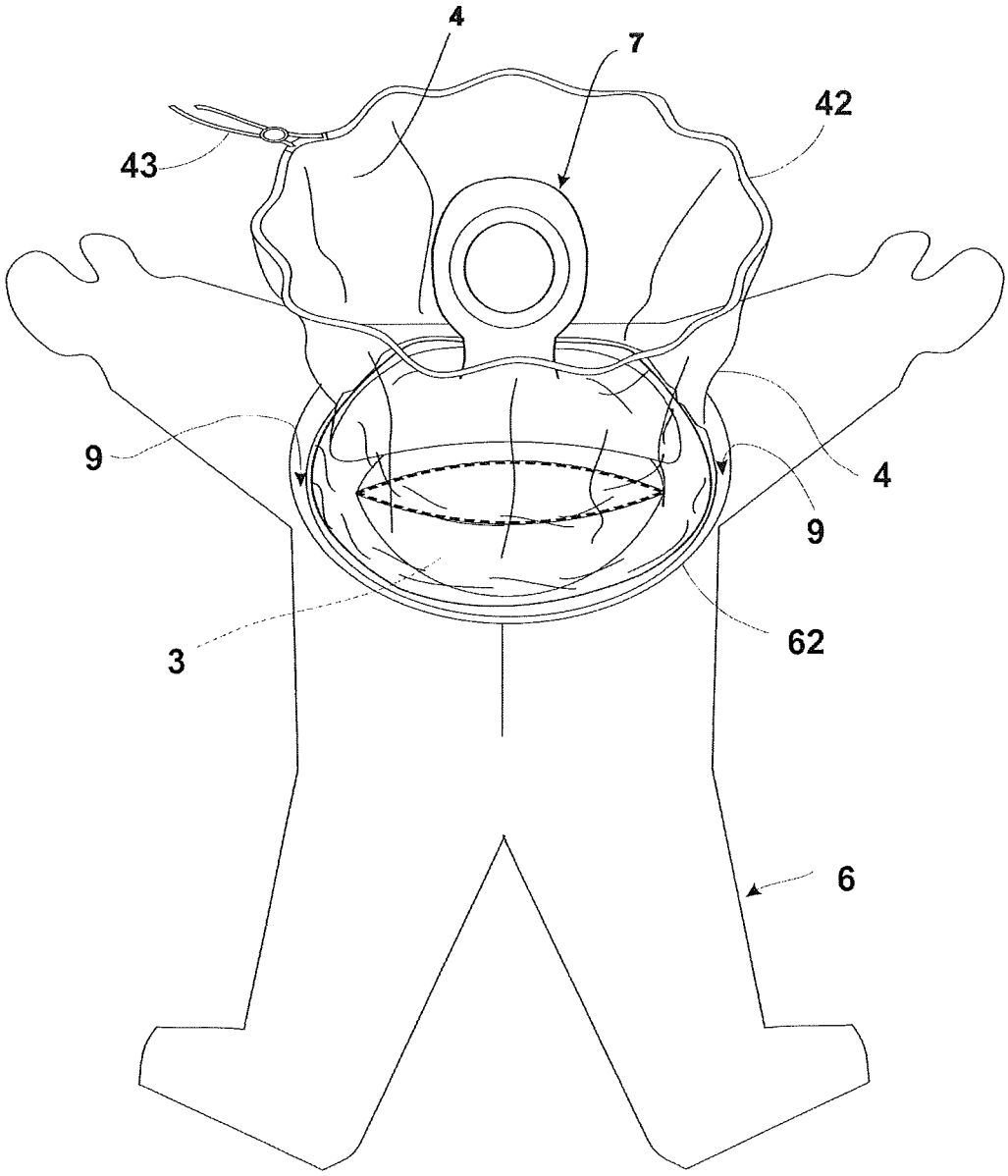

FIG. 14 is a front view, in elevation, of a suit in which the unfoldable sleeve is shown which is projected from the structure of insulating walls.

Figure 15:
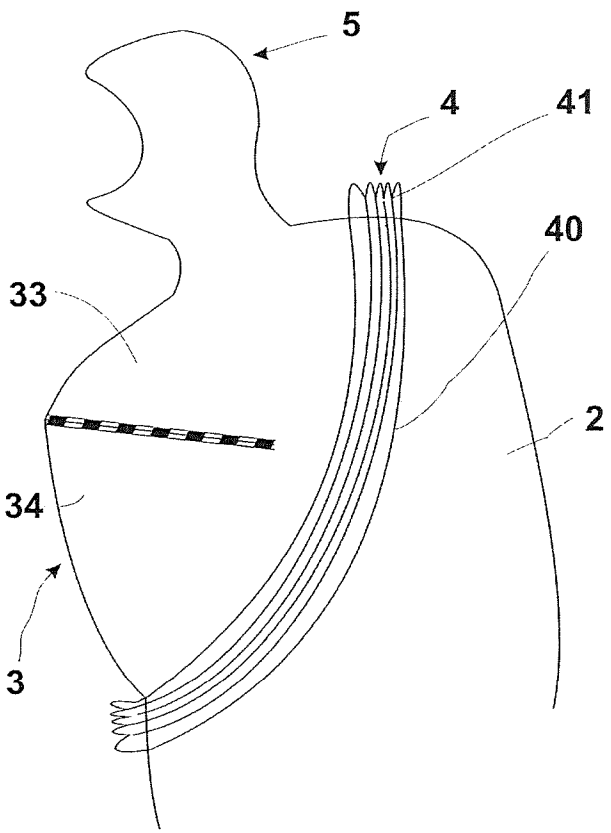
Figure 15:
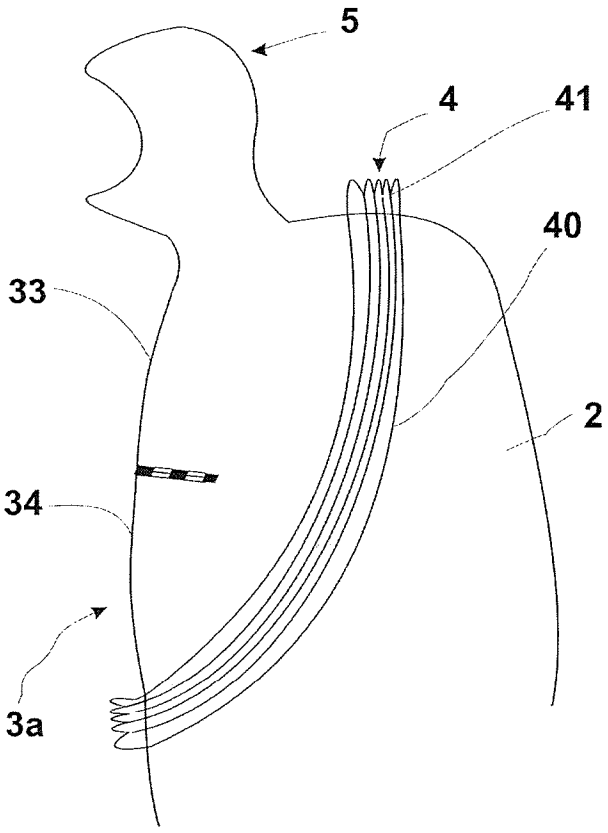

FIG. 15 includes drawings A and B, being:

Drawing A, a side view, in elevation, of an embodiment in which the front part is not protruding and in which the unfoldable sleeve can be seen around said front part and the hood, and Drawing B, a side view, in elevation, of another embodiment that includes a front protrusion and an adjacent hood, around which the unfoldable sleeve is arranged.

Figure 16:
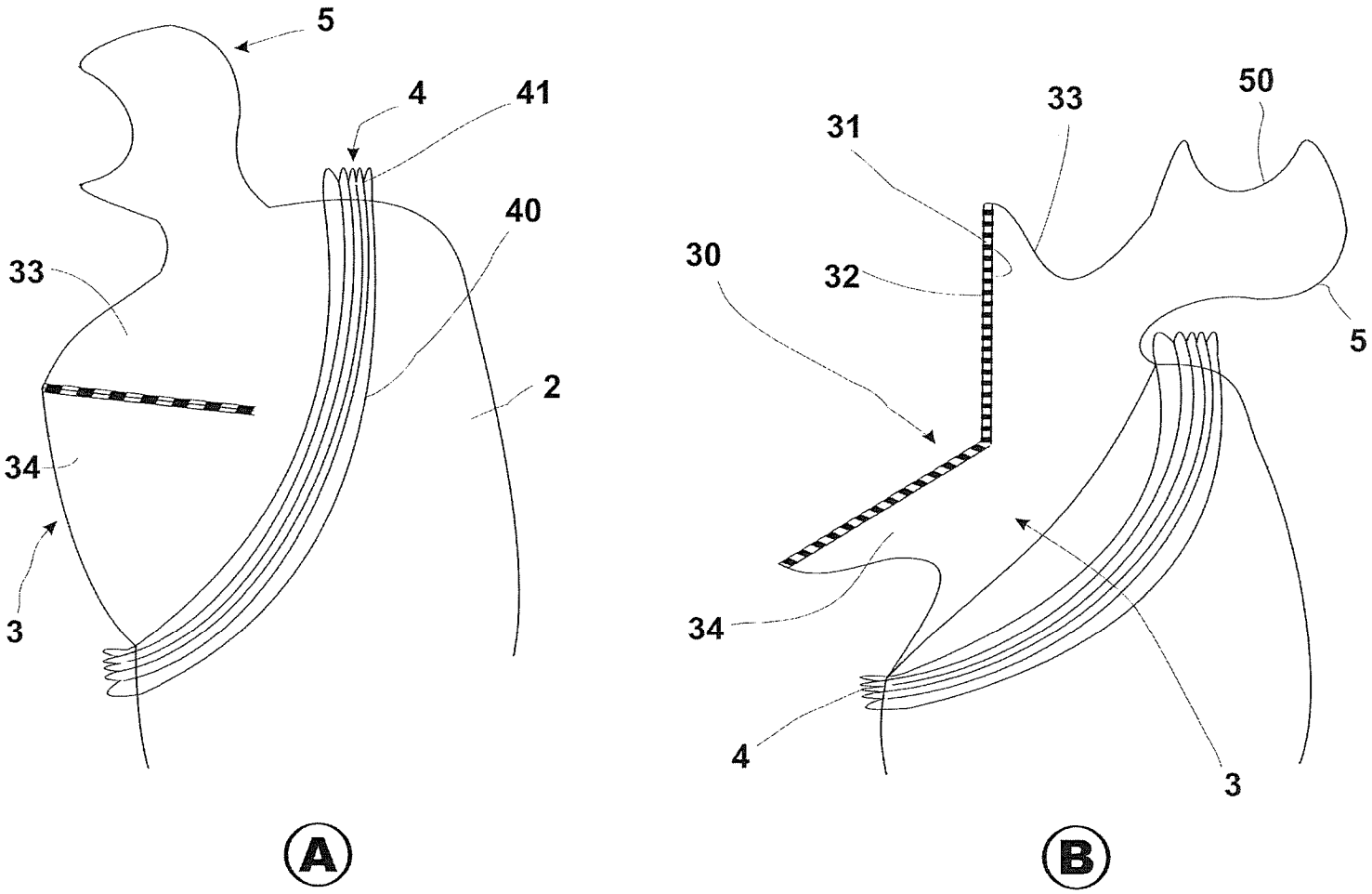

FIG. 16 includes drawings A and B, being:

Drawing A, a side view, in elevation, of the upper part of the suit in which the front protrusion can be appreciated and, around said protrusion and the hood, the unfoldable sleeve, and Drawing B, a side view, in elevation, of the upper part of the suit in which the transversal opening can be seen completely opened.

Figure 17:
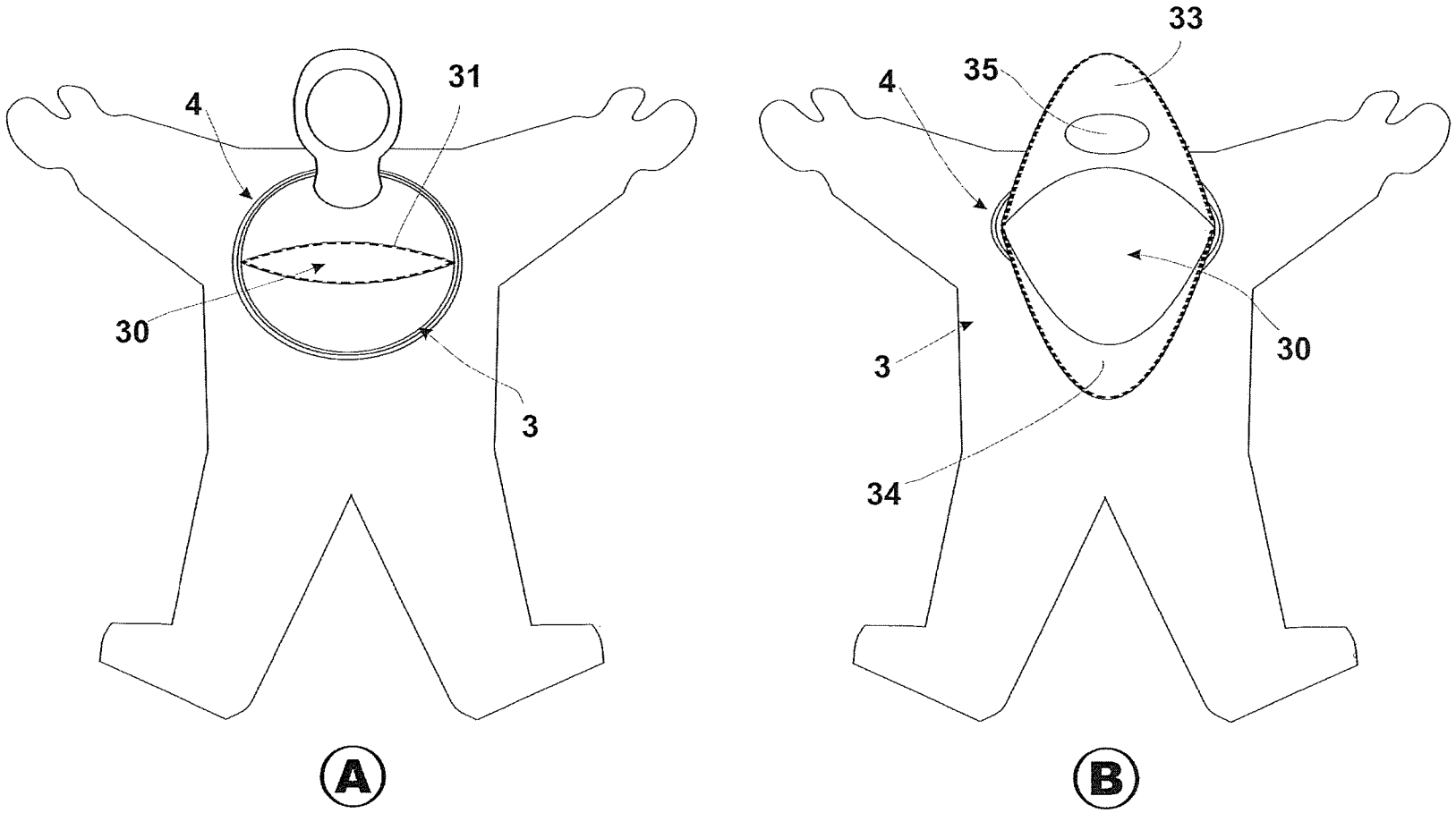

FIG. 17 includes drawings A and B, being:

Drawing A, a front view, in elevation, of the suit in which the front protrusion and the hood can be seen, around which the unfoldable sleeve works, and Drawing B, a front view, in elevation, of the suit in which the transversal opening can be seen completely opened and, within it, the headpiece opening.

Figure 18:
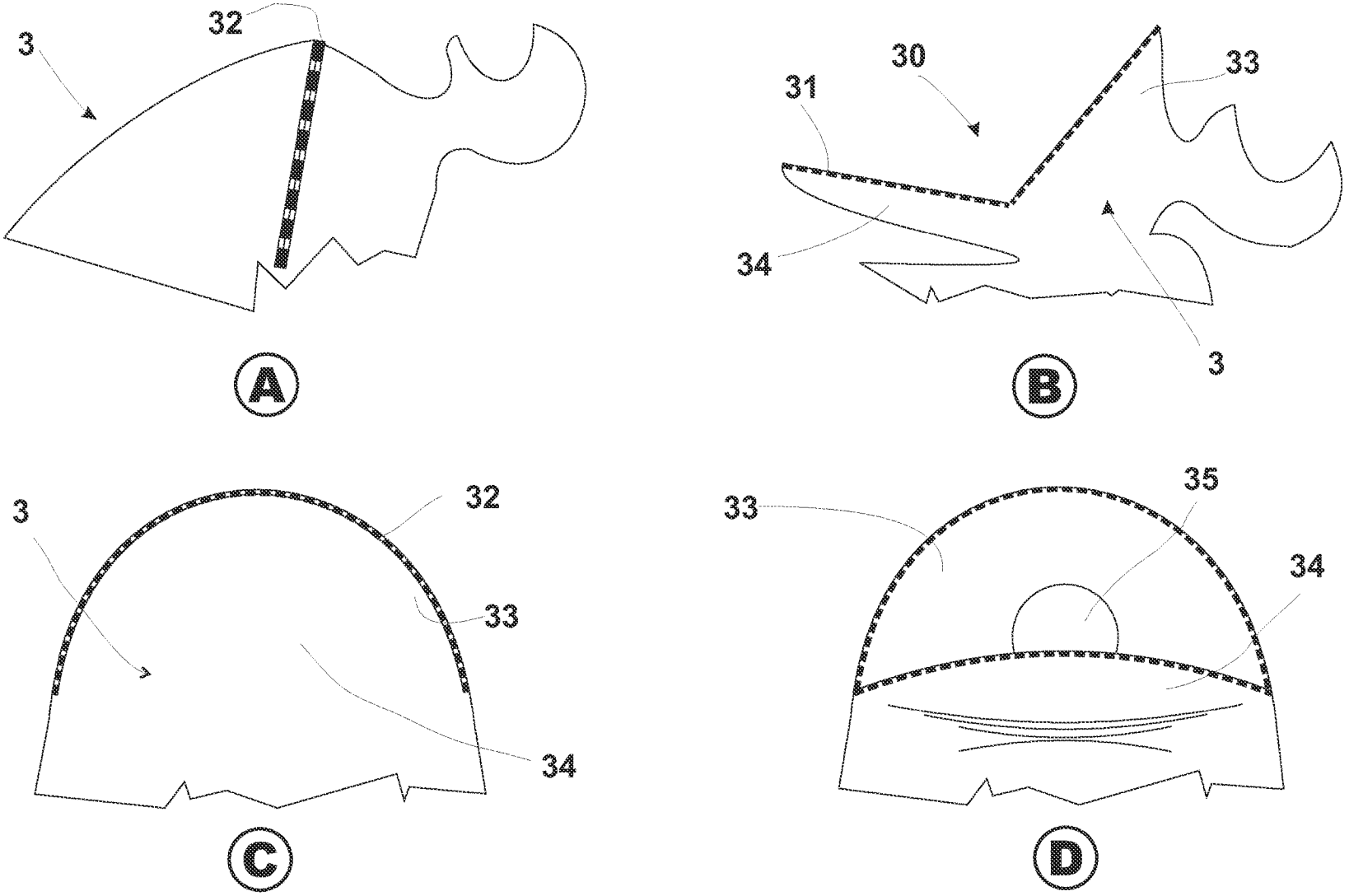

FIG. 18 includes drawings A, B, C and D, being:

Drawing A, another side view, in elevation, of the upper part of the suit in which the front protrusion can be seen, and Drawing B, another side view, in elevation, of the upper part of the suit in which the transversal opening can be seen completely opened;

Drawing C, a lower view of the suit of drawing A, and

Drawing D, a lower view of the suit of drawing B, in which headpiece adjacent part a headpiece opening can be seen.

Figure 19:
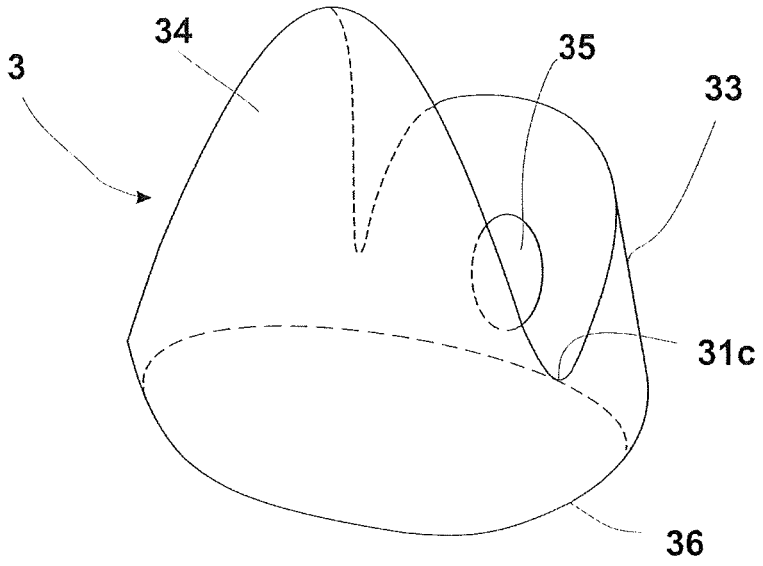

FIG. 19 is a perspective view of the front protrusion.

Figure 20:
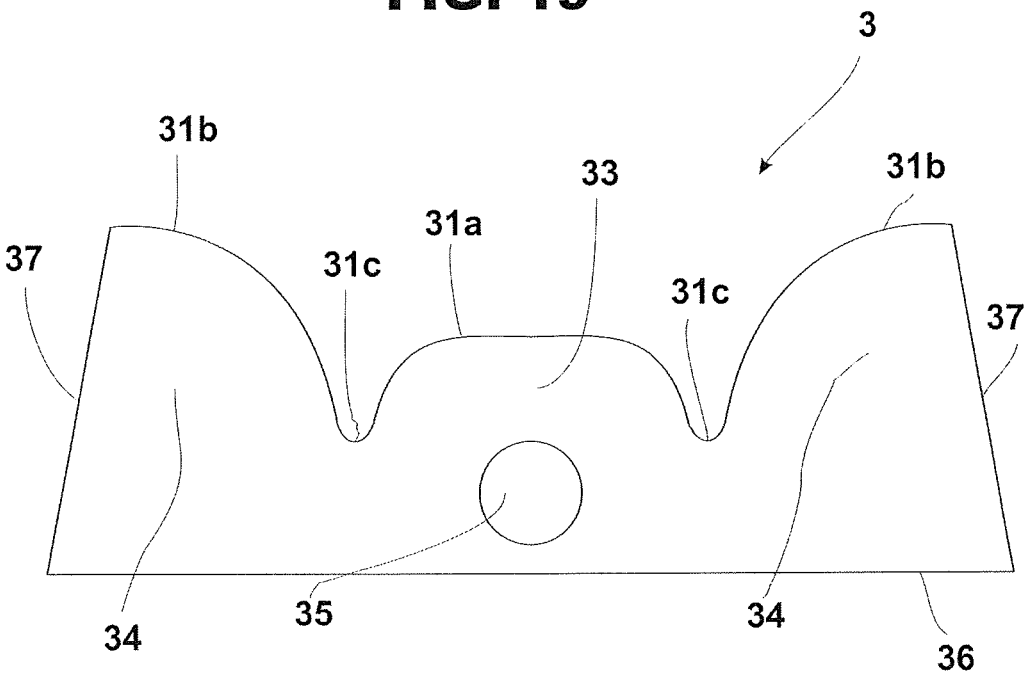

FIG. 20 is a side view of a piece of insulating walls with which the front protrusion is structured.

Figure 21:
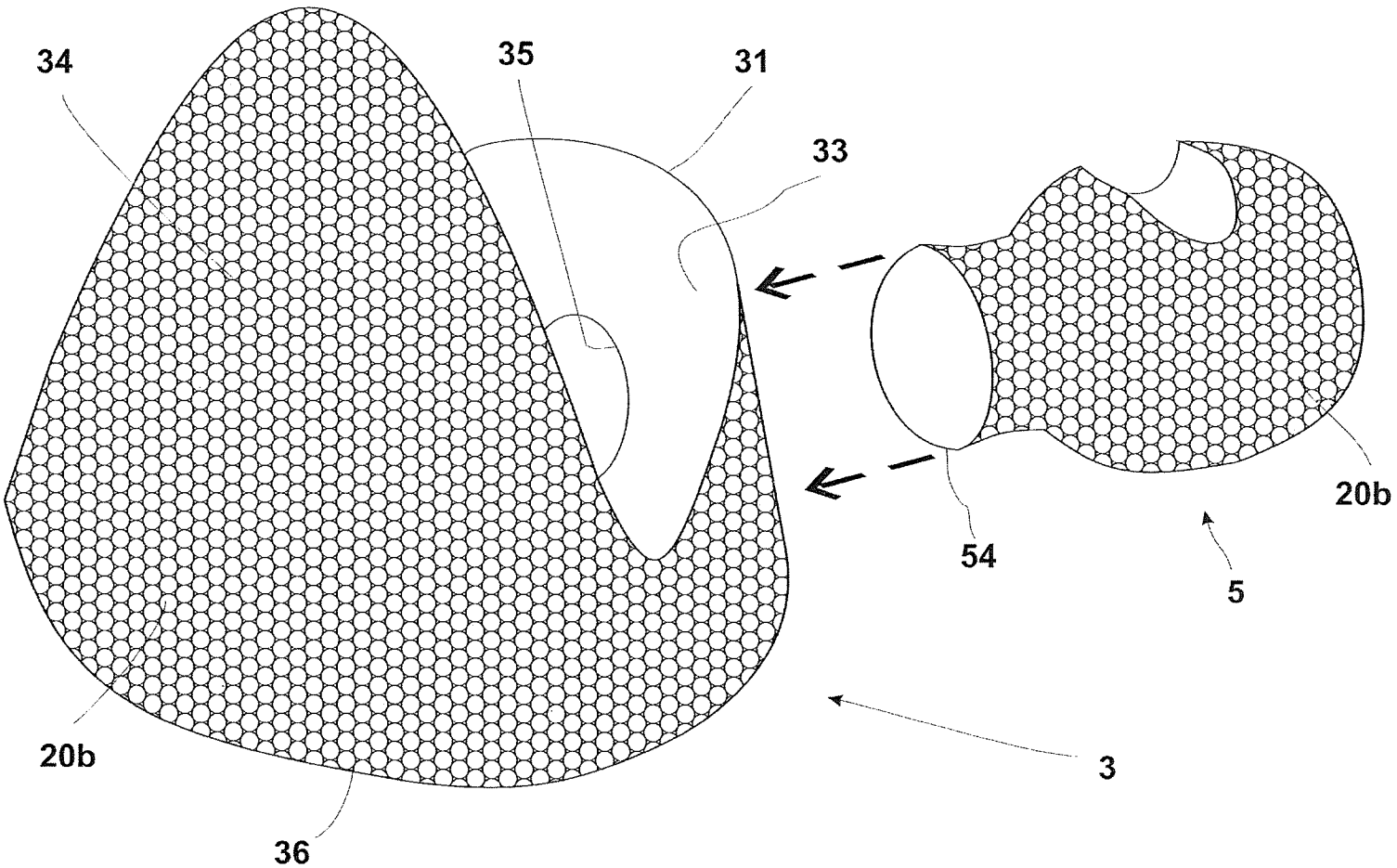

FIG. 21 is a perspective view of the front protrusion, where the hood is placed in front of the headpiece opening.

Figure 22:
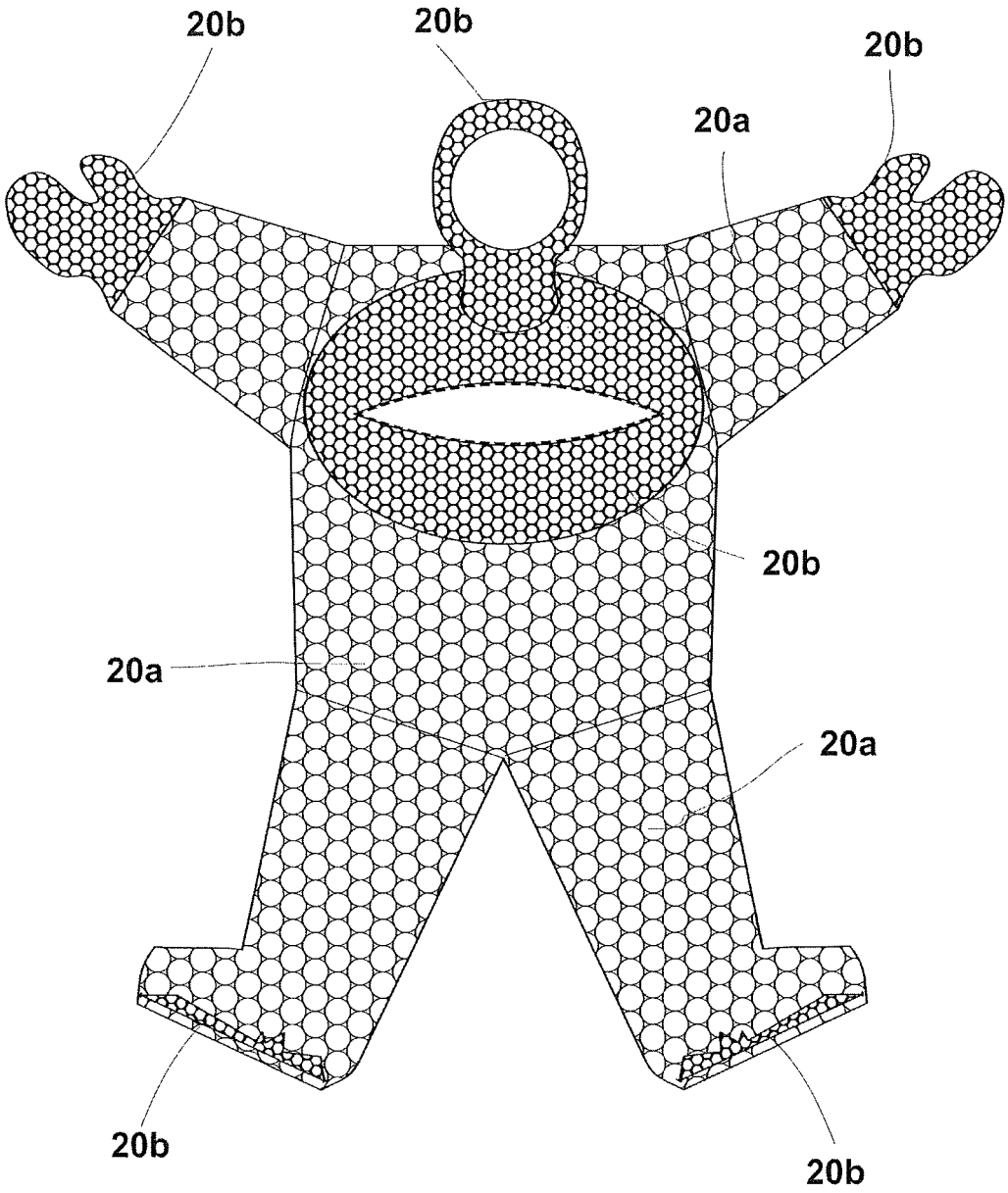

FIG. 22 is a front view, in elevation, of the insulating structure of the suit wherein the differentiated thermal insulation can be seen, due to micro and macro-alveolar walls. In the case of the feet, the partial cuts allow the view of the micro-alveolar walls added in the inner part of the feet.

Figure 23:
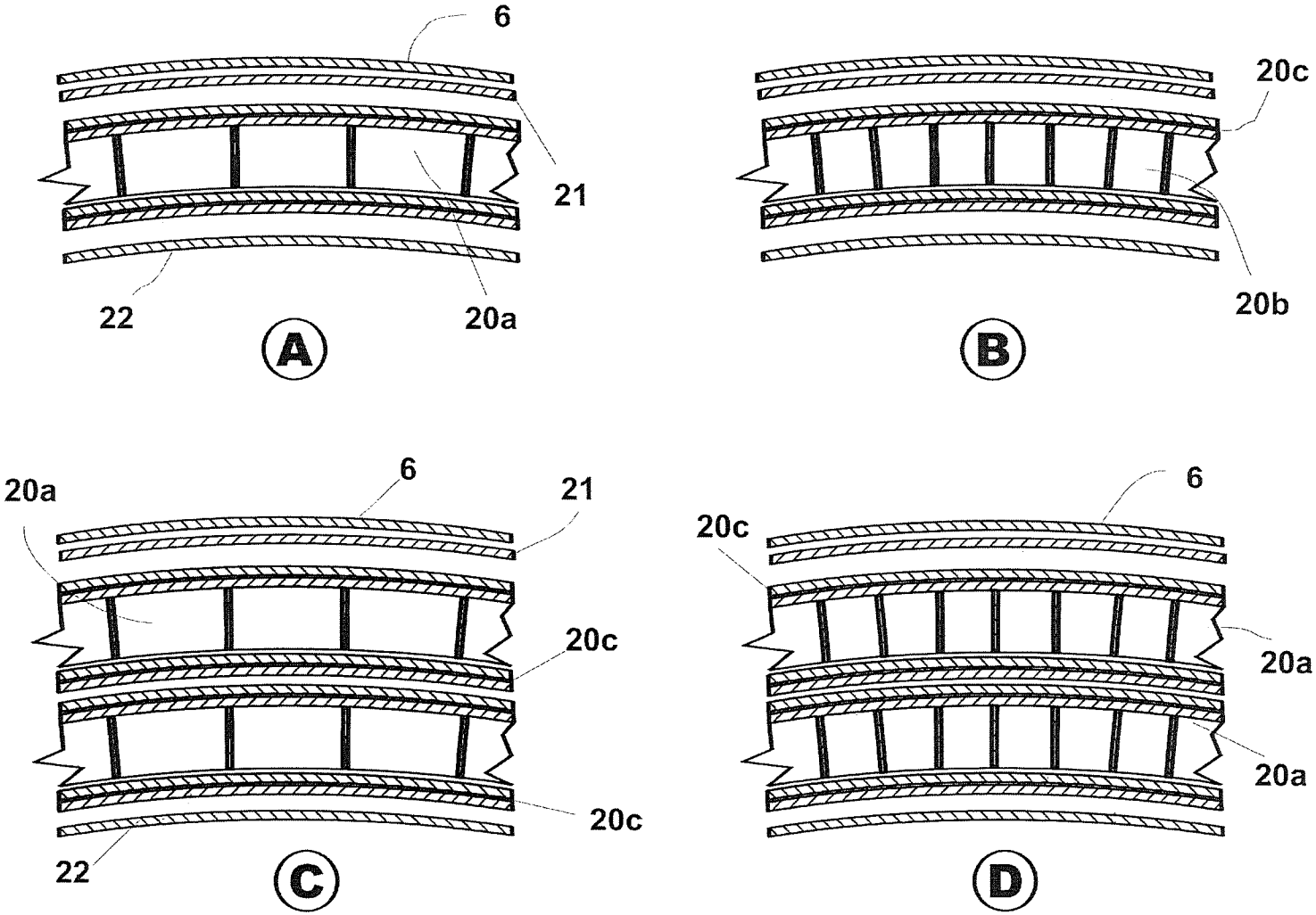

FIG. 23 includes drawings A, B, C and D, being:

Drawing A, a transversal cut of a single macro-alveolar wall,

Drawing B, a transversal cut of the single micro-alveolar wall;

Drawing C, a transversal cut of a double macro-alveolar wall; and

Drawing D, a transversal cut of a double micro-alveolar wall.

Figure 24:
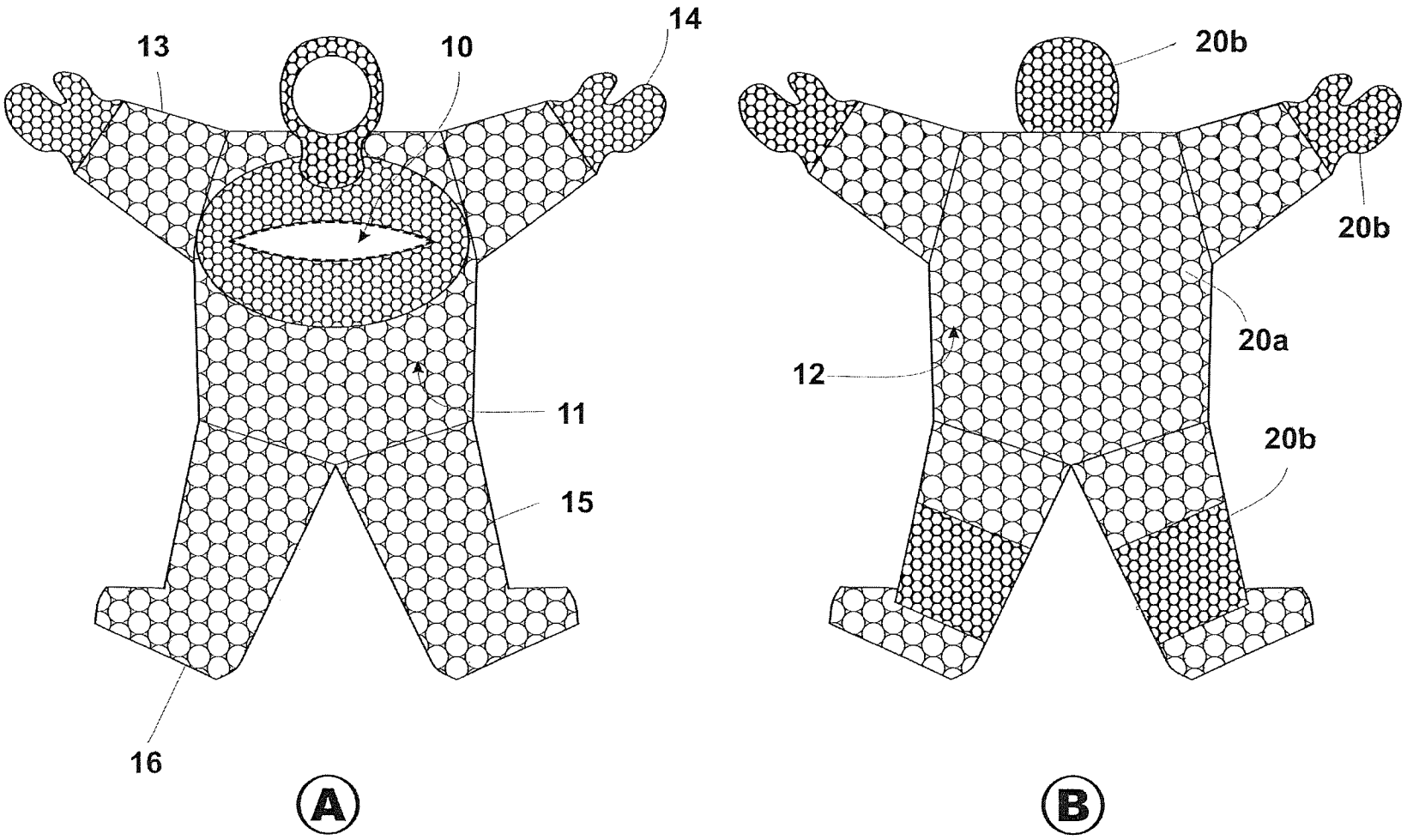

FIG. 24 includes the drawings A and B, being:

Drawing A, a front view, in elevation, of the suit in which the different types of reinforces are shown, with micro and macro-alveolar walls; and Drawing B, a rear view, in elevation, of the suit in which the different types of reinforces are shown, with micro and macro-alveolar walls.

Figure 25:
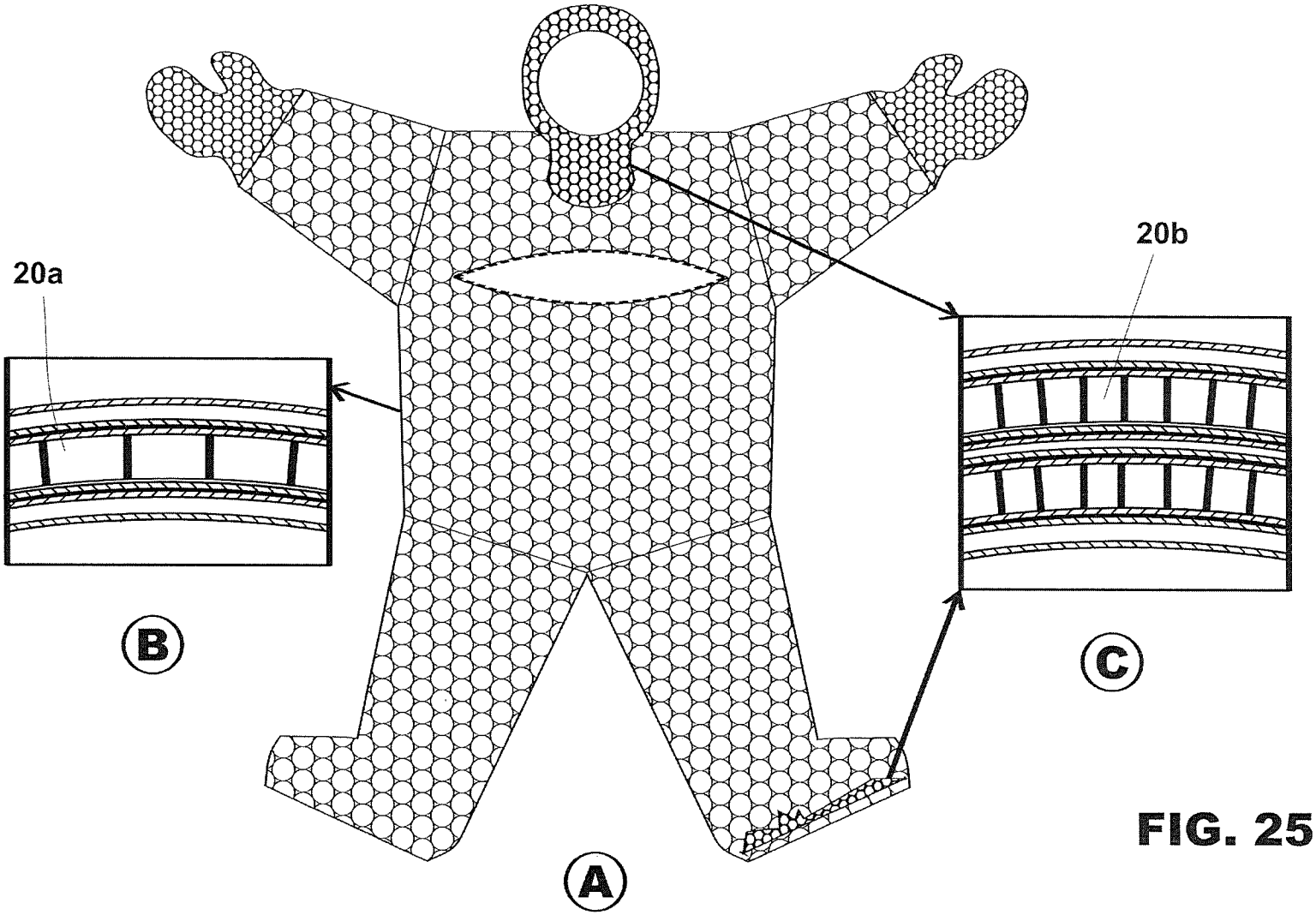

FIG. 25 includes drawings A, B and C, being:

Drawing A, a front view, in elevation, of a suit with a different type of alveolar walls.

Drawing B, a detail of a transversal cut of the body wall in which the single macro-alveolar wall can be seen and Drawing C, a detail of a transversal cut of the wall of the hood in which the double micro-alveolar wall can be seen.

Figure 26:
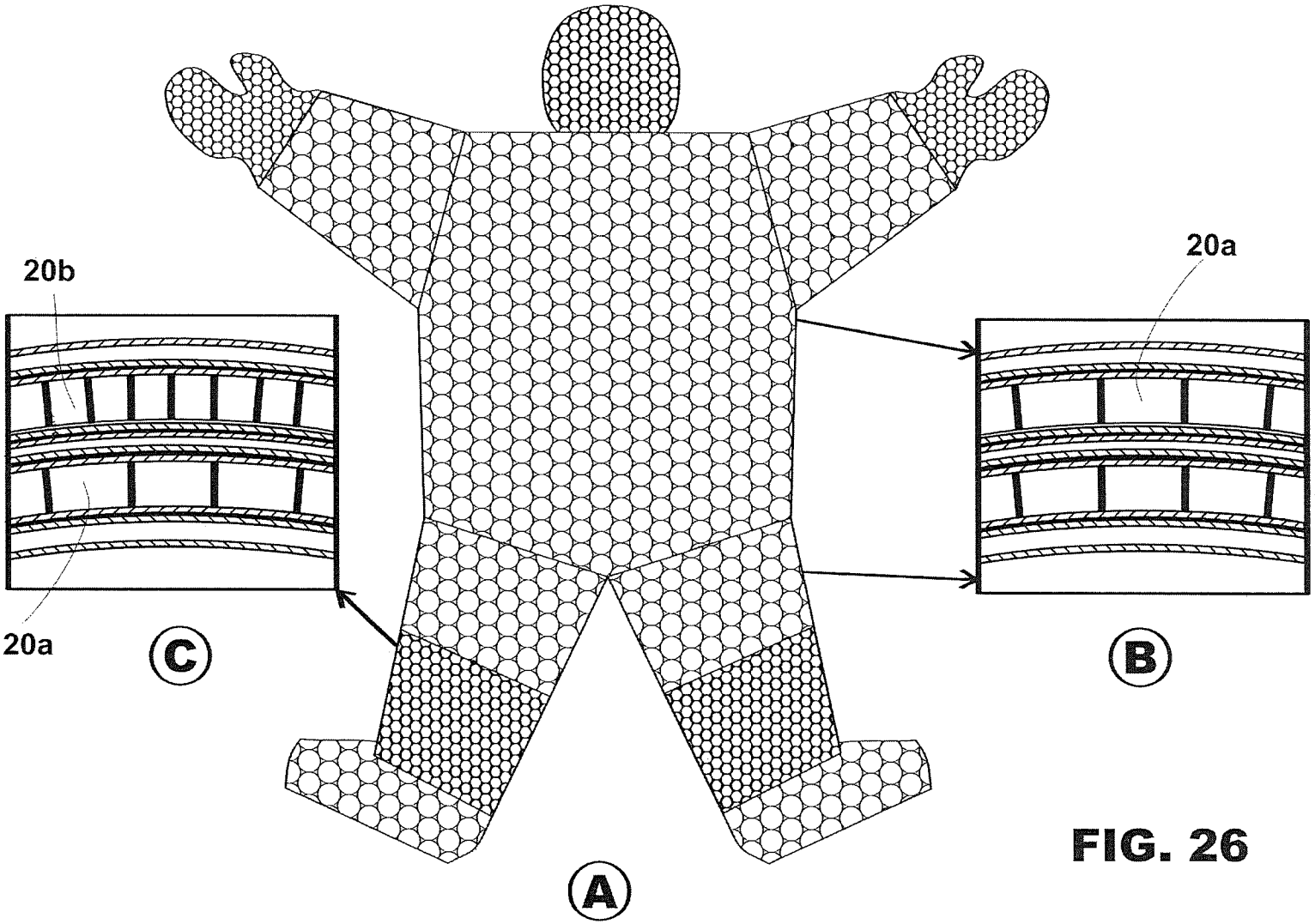

FIG. 26 includes drawings A, B, and C, being:

Drawing A, a rear view, in elevation, of the suit in which the different types of reinforces with micro and macro-alveolar walls are shown;

Drawing B, a detail of a transversal wall of two sectors of the body wall in which the double macro-alveolar wall can be seen and Drawing C, a detail of a transversal cut of the wall added outside the trouser leg which, in this case, includes a double micro-alveolar wall.

Figure 27:
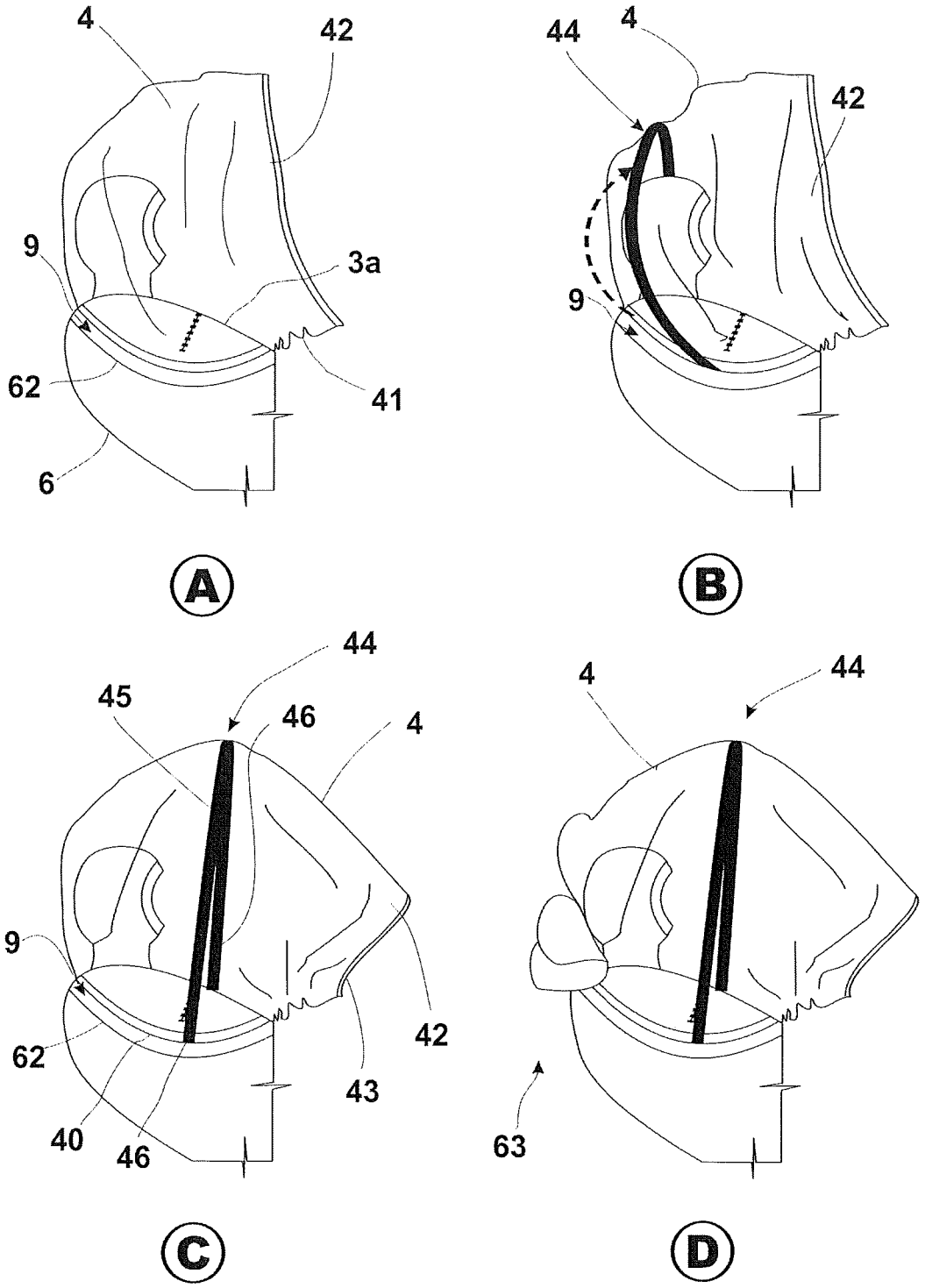

FIG. 27 refers to the suit in an embodiment in which its front part is not protruded. It includes drawings A, B, C and D, being:

Drawing A, a side view, in elevation, of the upper part of the suit where the partial unfolding of the unfoldable sleeve is shown;

Drawing B, a side view, in elevation, of the upper part of the suit where the unfolding of the unfoldable sleeve and partial unfolding of the unfolding support are shown;

Drawing C, a side view, in elevation, of the upper part of the suit, where the complete unfolding of the unfoldable sleeve and the unfolding support are shown; and Drawing D, a side view, in elevation, of the upper part of the suit where the complementary presence of a cervical float is shown.

Figure 28:
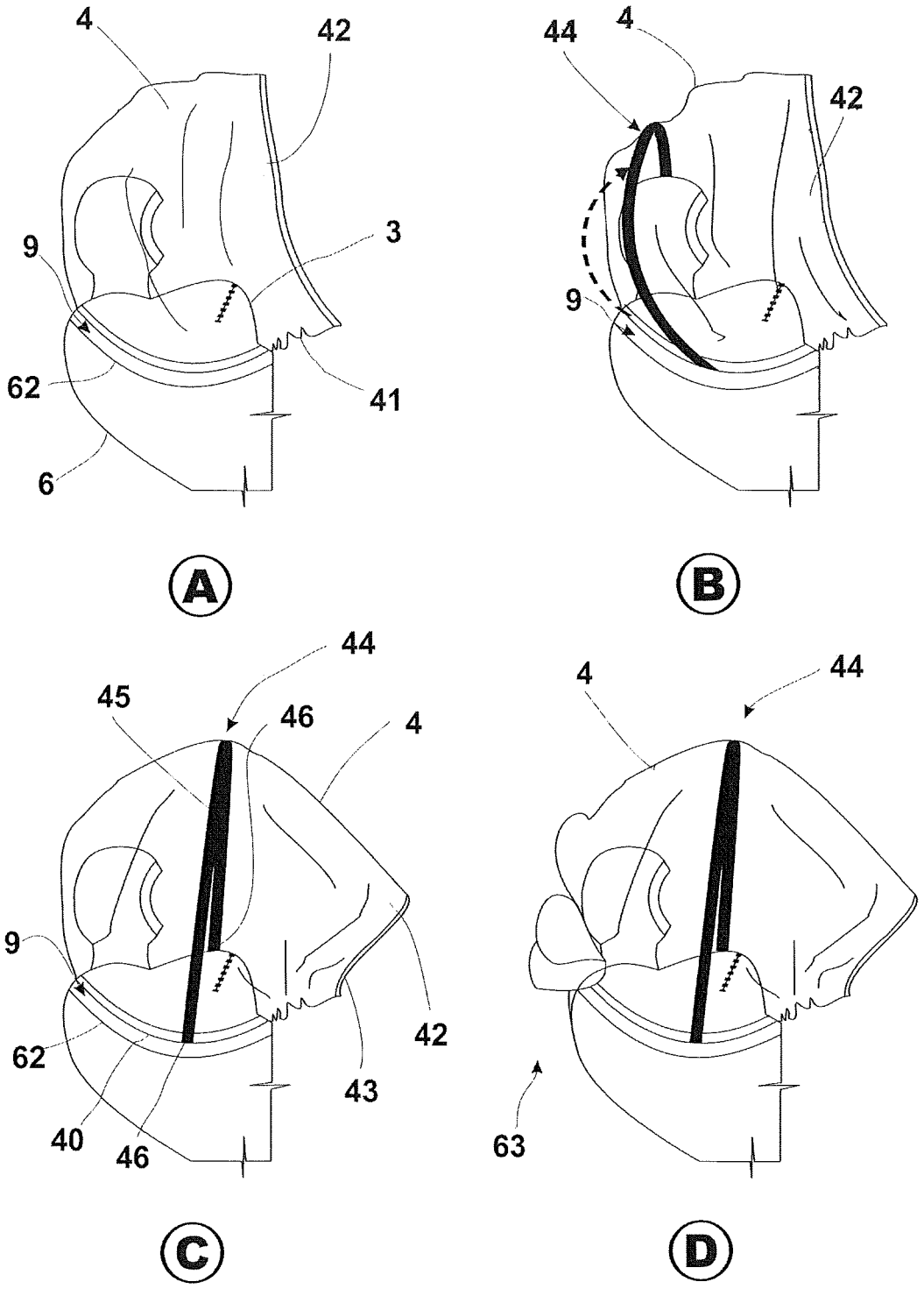

FIG. 28 refers to the suit in an embodiment where the front part is protruded. It includes drawings A, B, C and D, being:

Drawing A, a side view, in elevation, of the upper part of the suit where the partial unfolding of the unfoldable sleeve is shown;

Drawing B, a side view, in elevation, of the upper part of the suit where the unfolding of the unfoldable sleeve and partial unfolding of the unfolding support are shown;

Drawing C, a side view, in elevation, of the upper part of the suit, where the complete unfolding of the unfoldable sleeve and the unfolding support are shown; and Drawing D, a side view, in elevation, of the upper part of the suit where the complementary presence of a cervical float is shown.

Figure 29:
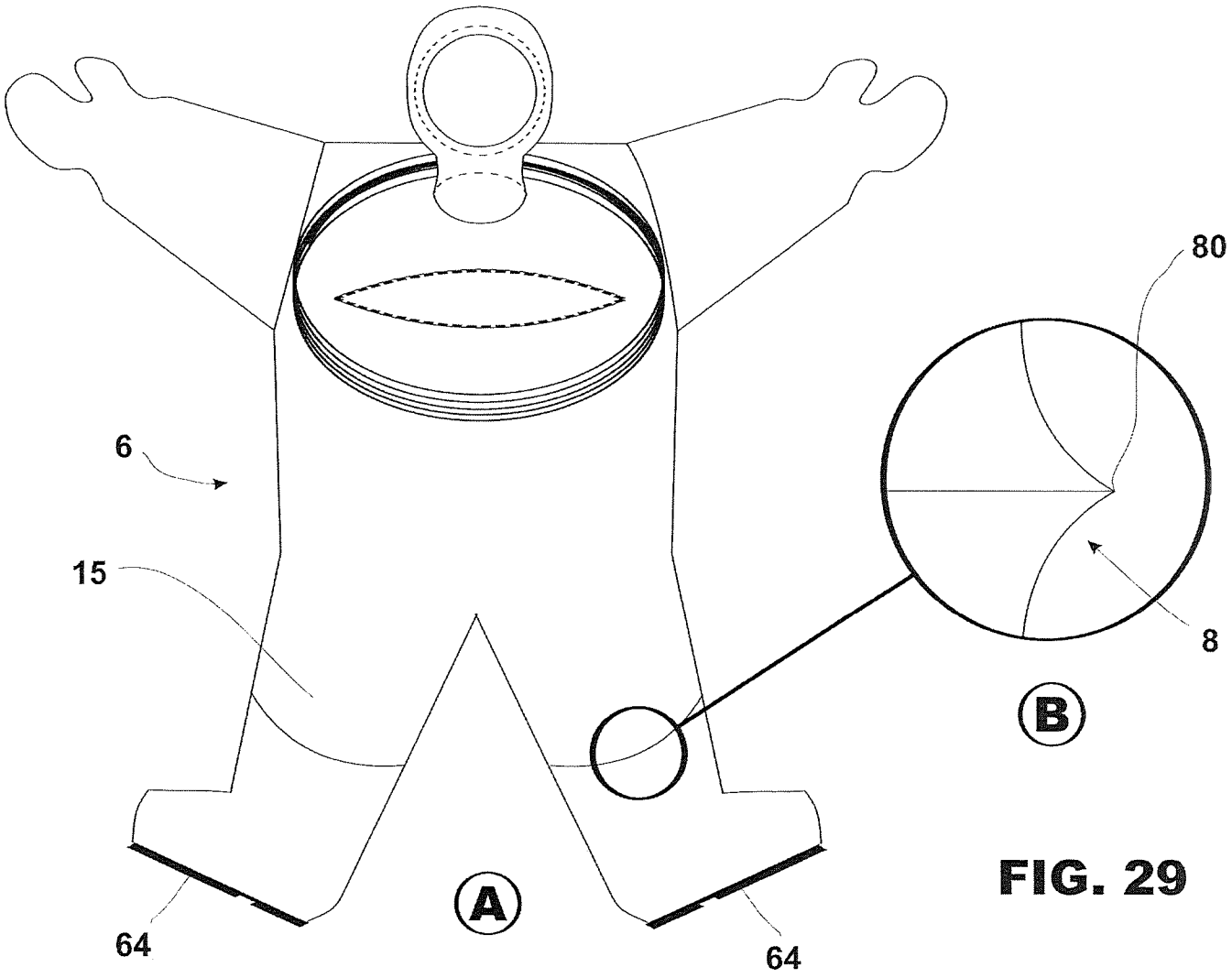

FIG. 29 includes the drawings A and B, being:

Drawing A, a front view, in elevation, of a variation of the suit in which the joint folds of the trouser legs are shown, at knees high; and Drawing B, a detail in side view, in elevation, of a joint fold.

Figure 30:
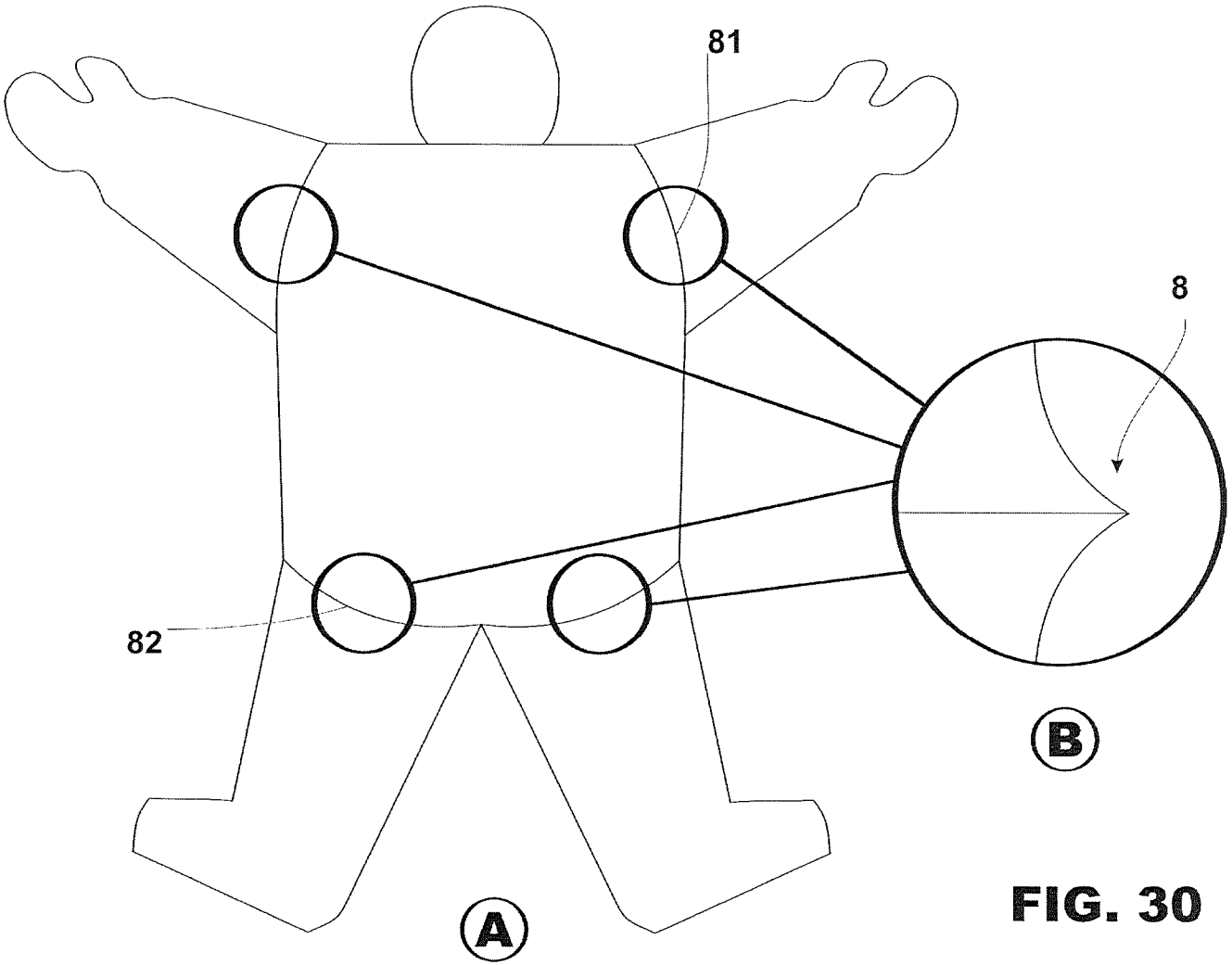

FIG. 30 includes drawings A and B, being:

Drawing A, a rear view, in elevation, of a variation in the suit in which the joint folds are shown in the junction between the back and the sleeves and the rear part where the trousers legs are born; and Drawing B, a detail in the side view, in elevation, in one of the joints folds.

Figure 31:
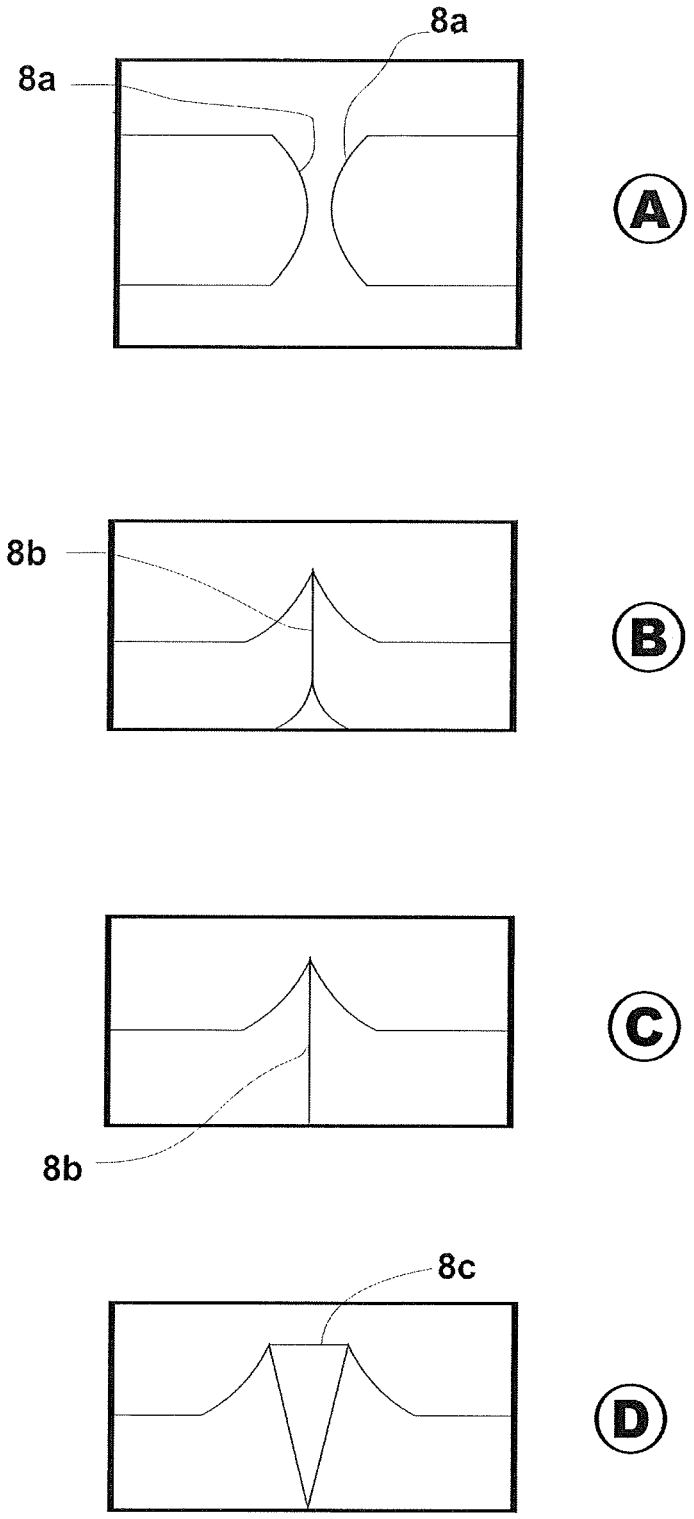

FIG. 31 includes the drawings A, B, C and D, being:

Drawing A, an upper view, in plain, of two faced juncture edges, prior to producing the joining;

Drawing B, a side view, in elevation, that shows the partial joining of the two juncture edges;

Drawing C, a side view, in elevation, that shows the complete joining between the two juncture edges; and Drawing D, a side view, in elevation that shows the complete joining between the two juncture edges with an intermediate interchangeable insert.

In the different figures, the same reference numbers and/or letters indicate equal or corresponding parts.

LIST OF THE MAIN REFERENCES (1) Suit.
(10) Inner receptacle or cavity of the suit (1).
(11) Front part of the body of the suit (1).
(12) Dorsal part of the body of the suit (1).
(13) Upper limbs of the suit (1).
(14) Mittens of the suit (1).
(15) Trouser legs of the suit (1).
(16) Feet of the suit (1).
(2) Structure of insulating walls.
(20) Alveolar walls.
(20*a*) Macro-alveolar walls.
(20*b*) Micro-alveolar walls.
(20*c*) Aluminized layer.
(21) Outer Wall [waterproof barrier].
(22) Inner wall.
(23) Detachable closings.
(3) Front protrusion.
(3*a*) Front Area [non protruding embodiment].
(30) Transversal access opening [to the inner cavity (10)].
(31) Curved edges of the transversal opening (30).
(31*a*) Headpiece curved edges.
(31*b*) Thoracic curved edges.
(31*c*) Corners of the curved edges (31).
(32) Hermetic closing means.
(33) Headpiece adjacent part.
(34) Thoracic adjacent part.
(35) Headpiece opening [in the headpiece adjacent part (33), communicates with the hood (5)].
(36) Edges of the union [between the front protrusion (3) and the rest of the front part (11)].
(37) Oblique union ends.
(4) Unfoldable sleeve.
(40) Base union [of the unfoldable sleeve (4) to the structure (2)].
(41) Unfoldable walls.
(42) End edges.
(43) End closing.
(44) Unfolding support.
(45) Elastic body of the support (44).
(46) Limbs of the unfolding of the support (44).
(5) Inner hood [belongs to the structure of the inner walls of the suit].
(50) Inner facial opening.
(51) Inner surrounding area.
(52) Inner union [with the hermetic frame (53)].
(53) Hermetic frame or hermetic structure.
(53*a*) Facial juxtaposition part [or inner frame].
(53*b*) Deformable filling.
(53*c*) Peripheral union edge [of the hermetic frame (53) with the inner union (52) of the hood (5)].
(53*d*) Outer part [or outer frame].
(54) Headpiece base [is joined to the headpiece opening (35)]
(6) Outer body cover.
(60) Upper opening of the outer body cover (6).
(61) Outer cavity.
(62) Body edge [of the upper opening (60)].
(63) Cervical floats.
(64) Non-slip soles [on the feet of the body cover (6)].

(7) Outer headpiece cover.
(70) Outer facial or front opening.
(70*a*) Outer surrounding area.
(71) Skirt of the outer headpiece cover (7).
(72) Headpiece edge.
(73) Adjustment system.
(74) Traction arrangement.
(740) Surrounding linepull connections.
(741) Traction strips.
(742) Front stretching connections.
(743) Elastic traction members.
(744) Pulling front passages.
(745) Back linepull connections.
(75) Convergent arrangement.
(750) Stretching loose rear connections.
(751) Rail fixed rear connections.
(751*a*) Fixing of rear connections (751).
(752) Lower manual stretching strips.
(753) Pulling ends of the stretching strips (752).
(754) Rear elastic stretching strips.
(755) Lower elastic stretching strips.
(756) Positional lock of ends (753).
(76) Rail passages [eyelets].
(77) Fixing of the linepull.
(78) Rear fixing or retention means [of the skirt (71)].
(8) Joint folds.
(8*a*) Juncture edges.
(8*b*) Junctures.
(8*c*) Juncture interchangeable insert.
(80) Leg fold.
(81) Sleeve fold.
(82) Lower trunk fold.
(9) Frame passage [formed between the body edge (62) and the headpiece edge
(72), whereby the unfoldable sleeve is unfolded (4)].
(100) Drainage passages.

DETAILED DESCRIPTION

In general terms, the present invention refers to a salvage suit for shipwrecks with high functionality and insulation that includes the access opening (30) to the inner receptacle and a facial opening (50) that are independent; around the facial opening (50), the structure of insulating walls (2) includes a hood (5) and both openings, access (30) and facial (50), are surrounded by an unfoldable sleeve (4) that is projected from the structure of insulating walls (2); the outer cover of protection includes an outer headpiece cover (7) that covers the hood (5) and an outer body cover (6) that are separated by a frame passage (9) through which said unfoldable sleeve (4) is capable of unfolding, until forming an environmental protection over said headpiece hood (5) and over said access opening (30).

In general, the present salvage suit (1) has the capacity of containing the body of a person in its inner cavity (10), giving thermal and hydrological protection and forming a flotation unit. This suit (1) defines a receptacle according to the anatomic form of a person, but with the sufficient width to allow, such as a floating mini-cabin, that the person moves within said receptacle. It includes the structure of insulating walls (2) and an outer cover, both in the body and headpiece part, as well as in the trouser legs (15) and arms (13).

In particular, this suit (1) includes an access opening (30) to the inner receptacle and a facial opening (50) that are independent, one with regards to the other.

Around the facial opening (50), the structure of insulating walls (2) forms a hood (5), while around the access opening (30), said structure (2) can be plain or form a front protrusion (3).

Both openings, access (30) and facial (50), are surrounded by an unfoldable sleeve (4) that is projected from the structure of insulating walls (2).

The protection outer cover includes, at least, an outer headpiece cover (7) that covers the inner hood (5) and an outer body cover (6) which outer cavity (61) hosts the structure of insulating walls (2). Therefore, the outer cover covers the body [front part (11) and dorsal part (12)] and the limbs [upper limbs (13), mittens (14), trouser legs (15) and feet (16)]. In different areas, the covers (6, 7) are related to the structure of insulating walls (2) by means of elements suitable for that purpose such as, for example, detachable closings (23).

The headpiece cover (7) and body cover (6) are separated by a frame passage (9) through which the mentioned unfoldable sleeve (4) is capable of unfolding, until forming an environmental protection or protected environment over the headpiece hood (5) and over the access opening (30). More specifically, the frame passage (9) is found between the body edge (62) of the body cover (6) and the headpiece edge (72) of the outer headpiece cover (7).

In an adjacent manner to the mentioned frame passage (9), in the upper part of the body cover (6), the possibility of applying one or more cervical floats (63) was foreseen. For example, in the area adjacent to the body edge (62) of the upper opening (60) of the outer body cover (6), in a way that they are placed behind the hood (5) and help maintaining the head of the shipwreck survivor held high when he is laid down, floating in the water.

This outer unfoldable sleeve has a base union (40) that links its unfoldable walls (41) with the structure of insulation walls (2). The possibility that an elastically unfoldable member can be available—equipped with an elastic body (45) finished in unfoldable limbs (46)—that acts as unfolding support (44) of said unfoldable sleeve (4) has been foreseen. It has also been foreseen that this unfoldable sleeve (4), in its end edges (42), has end closing (43) means of it outer opening, which improves the environmental protection it provides.

The headpiece cover (7) has, at least, a retention or holding means that relates the skirt (71) to the structure of insulating walls (2). This retention or rear fixing means (78) can be of quickly opening and closing as, for example, a union of "Velcro" or thistles type.

On the other hand, the inner hood (5) is related to the outer headpiece cover (7) around the inner facial opening (50) from which the face of the user appears.

Furthermore, the headpiece cover (7) and the hood (5) are under the influence of a traction arrangement (74) that, from linepull connections adjacent to an outer surrounding area (70*a*) to the outer facial opening (70), is capable of exerting pressure of facial integration over the inner surrounding area (51).

The traction arrangement (74) acts as from the influence exerted by a rear convergent arrangement (75), to which some linepull branches converge that connect the linepull connections with the rear convergent disposition (75).

The convergent arrangement (75) and the traction arrangement (74) are mounted in the inner part of the outer headpiece cover (7) of the suit (1), acting over the hood (5) through the connection between the hood (5) and the headpiece cover (7). This connection is done through the hermetic structure (53), that links the inner union (52) of the hood (5) with the outer surrounding area (70*a*) of the outer headpiece cover (7).

In one embodiment, the traction arrangement (74) includes fixed linepull connections (745) placed beyond the middle area—for example at the rear area—of the outer headpiece cover (7), from which they are capable of exercise stretching over the outer surrounding area (70*a*) of the outer facial opening (70).

The traction arrangement (74) acts as from the influence exercised by the stretching strips (752) that, from the rear convergent arrangement (75), connect, at least, part of said fixed linepulls (745), as can be seen in the corresponding figures.

In another embodiment, the stretching strips are elastic means that maintain the traction arrangement (74) usually tightened and exercising constant stretching.

In another embodiment, the traction arrangement (74) includes traction strips (741) related to the surrounding linepulls connections (740) fixed to the outer surrounding area (71) of the outer facial opening (70). Instead, the convergent arrangement (75) includes free rear connections (750) through which both said traction strips (741) and stretching strips (752) pass. On the other hand, the convergent arrangement (75) includes, at least, a fixed rear connection (751) [through fixing of the linepulls (77)] through which stretching strips pass (752)).

More particularly, in an embodiment, the traction arrangement (74) includes some anterior-posterior traction strips (741) that, as of the links or linepull connections (740) of the outer surrounding area (70*a*) to the outer facial opening (70), exercise their action towards the converging arrangement (75).

The linepull connections include the corresponding linepull connections (740) fixed to said outer surrounding area (70*a*) of the outer facial opening (70), while the convergent disposition (75) includes rear connections (750, 751) through which said traction strips (741) remain under the influence of some stretching strips (752).

Each stretching strip (752) has a link or front stretching connection (742) and a front or anterior passage (744) through which the pulling end emerges (753) from said stretching strip (752).

To maintain the adjustment (73) of the system, after producing the stretching, the use of means of positional lock (756) [for example, the ones named TANCA type] has been foreseen, that, applied to the pulling ends (753) of the stretching strips (752), produce a lock against the front part (11) of the hood (5) or against the eyelets of the front passages (744), preventing the loosening of the system.

In another embodiment, the traction disposition (74) includes some elastic anterior-posterior traction strips (741) that, as of the links or linepull connections (740) of the outer surrounding area (70*a*) to the outer facial opening (70), exercise their action towards the convergent arrangement (75).

The convergent arrangement (75) includes rear connections (750, 751) through which said traction strips (741) remain under the influence of some stretching strips (754, 755).

At least, the stretching strips (754, 755) are elastic and are usually stretched in a way that they exert constant stretching force over said traction strips (741).

In both embodiments described, the links can include different elements that are suitable for the desired effect, such as free or rail passage openings (76), buckles with or without locks, Tancas (holdings for cords or tapes also known by the English expression "cord lock"), flexible members with a fixation end and provided with eyelets, etc.

In another embodiment, the traction arrangement (74) and the convergent arrangement (75) are formed by elastic wall members that, as of links or linepull connections (740) in the outer surrounding area (70*a*) to the facial opening (50), define some branches of linepull or elastic traction limbs (743) that converge in a rear convergent arrangement (75). There is also a possibility that the different elements form part of a same piece that forms them.

On the other hand, in the inner hood (5), it has been foreseen that the inner facial opening (50) has a hermetic structure (53) that gives it a proper tightness.

The hermetic structure (53)—which peripheral union edge (53*c*) is linked to the inner union (52) of the hood (5)—includes a frame (53) of a deformable and non-slip plastic material that, under pressure, is capable of immovably fix to the user face. In an embodiment, said hermetic structure (53) includes a neoprene frame.

In other embodiments, the hermetic structure (53) can include a frame comprising, for example, an inner frame or facial juxtaposition part (53*a*), a frame or outer part (53*d*) and an intermediate filling (53*b*).

The inner frame or face juxtaposition part (53*a*) includes a deformable and non-slip plastic material that, under pressure, is capable of immovably fix to the user face. It has been foreseen that this inner frame be structured in suitable materials for its function, such as the polyether. Outside this inner frame or juxtaposition part (53*a*) the intermediate elastic deformable filling (53*b*) and the outer frame or part (53*d*) that covers the front part (11) are arranged. The mentioned elastic filling (53*b*) has the capacity of maintaining the hermetic structure (53) usually expanded.

This suit (1) has a structure of insulating walls (2) that forms both the body and the headpiece part, as well as the trouser legs (15) and the arms. These insulating walls (2) include aluminized (20*c*) alveolar walls (20) with thermal insulation and buoyancy capacity. For the purpose of present description, micro-alveolar walls (20*b*) shall mean those walls which alveoli are smaller than 20 mm. With the same purpose, macro-alveolar walls (20*a*) shall be those walls which alveoli are equal or bigger than 20 mm. It is clear that this is a matter of reference definition with the purpose of differentiating the alveolar walls (20) according to the smaller or bigger size of their alveoli.

This is important, among other things, due to the fact that it allows that the structure insulating walls (2) defines a sectorial differential insulation. This can be determined both by the size of the alveolar cells, as well as by the amount of walls and/or composition of these walls (2).

The possibility of a sectional differential insulation including, for example, micro-alveolar walls (20*b*) with alveoli smaller than 20 mm, in the limb areas, of the front protrusion (3) and the headpiece part, have been foreseen. Instead, the presence of macro-alveolar walls (20*a*), with alveoli equal or bigger than 20 mm, can be used in the rest of the suit (1).

Furthermore, it has been foreseen that the structure of insulating walls (2) includes, at least, en outer wall (21) that can be of materials such as a polyether and that, mainly, acts as a barrier against water.

On the other hand, the optional presence of an inner wall (22) in contact with the user body has been foreseen.

Also, it has been foreseen that the structure of insulating walls (2) defines a sectorial differential functionality, including micro-alveolar walls (20*b*) in areas that require more mobility that others, where macro-alveolar walls (20*a*) can be placed.

In an embodiment, in the front part (11) of the body, the unfoldable sleeve (4) surrounds the not protruding front area (3*a*) in which the transversal access opening (30) is placed. This last one defines two adjacent parts (33, 34), that are functionally movable until reaching the expansion of said transversal access opening (30). This access opening (30) has hermetic closing means (32).

In another embodiment, said front part (11) of the body presents a front protrusion (3) that ends in a transversal access opening (30) of curved edges (31) that constitute de access to the inner receptacle.

This transversal access opening (30) has hermetic closure means applied to its curved edges (31), which separate two adjacent parts (33, 34), that are functionally movable until reaching the expansion of said transversal access opening (30).

More particularly, the front protrusion (3) forms a tapered initial part, as a frame, from which the walls that form the adjacent parts (33, 34) are extended to the transversal opening (30) of curved edges (31*a*, 31*b*). These parts (33, 34) adjacent to the transversal opening (30), include a thoracic adjacent part (34)—ending in thoracic curved edges (31*b*)—and a headpiece adjacent part (33)—ending in headpiece curved edge (31*a*)—in which there is a headpiece opening (35) that communicates with the hood (5).

The possibility that the headpiece adjacent part (33) be less protruded than the thoracic adjacent part (34) has been foreseen. In this way, the mirror protrusion of the headpiece adjacent part (33) facilitates the insertion of the user's head through the headpiece opening (35) that communicates with the hood (5).

From the wall structure viewpoint, the front protrusion (3) can be formed of a structure of isolating walls (2) that includes one or more alveolar walls (20).

Apart from the thermal insulation, the adjacent parts (33, 34) have an structure of insulating walls (2) which flexibility allows the divergent dumping of said adjacent parts (33, 34), which is facilitated due to the presence of some corners (31*c*) in the curved edges (31). In this way the expansion of the transversal access opening (30) can be easily produced, which may then be closed with a hermetic closing means (32) arranged in the mentioned curved edges (31).

In an embodiment, the front protrusion (3) is formed by a structured piece in insulating walls (2) which union edges (36) are joined to the rest of the front part (11). This front protrusion (3) is arranged so that, with the union of its ends (37), a frame which curved edges (31) define the access opening (30) is formed.

The mentioned union ends (37) are preferably oblique so that they converge towards the access opening (30). In this way, the frame edges behave as fitting invitation edges that facilitate the introduction of the user within the suit receptacle (1).

In this case, furthermore, the headpiece opening (35) is joined to the headpiece base (54) of the inner hood (5).

On the other hand, the structure of insulating walls (2) allows the incorporation of joint folds (8) such as leg folds (80), sleeve folds (81) and lower trunk folds (82). In an embodiment, these joint folds (8) are formed through a juncture (8*b*) between the juncture edges (8*a*). In another embodiment, a juncture interchangeable insert (8*c*) is incorporated which is placed between the juncture edges (8*a*).

Finally, it has been foreseen that, at least, the outer body cover (6) is provided with drainage passages (100) that prevent the accumulation of water in its outer cavity (61).

Undoubtedly, upon putting the present invention into practice, modifications may be introduced regarding certain construction details and form, without leaving the essential principles that are clearly explained in the claims below.

The invention claimed is:

1. A salvage suit for shipwrecks with high functionality and insulation, which, having the capacity of containing the body of a person or user in its inner cavity, gives thermal and hydrological protection, forming a flotation unit that:

defines a receptacle according to the anatomic form of a person, but with the sufficient width to allow, such as a floating mini-cabin, that the person moves within said receptacle, includes a structure of insulating walls both in the body and in the headpiece part, as well as in the trouser legs and arms, said structure of insulating walls has an outer cover of protection, wherein:

it has an access opening to the inner receptacle and a facial opening that are independent, around said facial opening, the structure of insulating walls has a hood, both openings, access and facial, are surrounded by an unfoldable sleeve that is projected from the structure of insulating walls, the outer cover of protection includes a headpiece cover that covers the hood and a body cover and said headpiece cover and said body cover are separated by a frame passage (9) through which the mentioned unfoldable sleeve is capable of unfolding, until forming an environmental protection over said headpiece hood and over said access opening.

2. The salvage suit according to claim 1, wherein the headpiece cover includes, at least, a retention means that links it to the structure of insulating walls.

3. The salvage suit according to claim 2, wherein the retention means is of quickly opening and closing as a union of hook and loop fasteners.

4. The salvage suit according to claim 1, wherein the outer unfoldable sleeve includes, at least, an elastically unfoldable limb that acts as unfolding support of said outer unfoldable sleeve.

5. The salvage suit according to claim 1, wherein the outer sleeve includes an outer opening of said outer unfoldable sleeve, said outer opening being configured and adapted to be closed.

6. The salvage suit according to claim 1, wherein:

the hood is related to the headpiece cover around a facial opening for the face of the user, said headpiece cover and said hood are under the influence of a traction arrangement that, from linepull connections adjacent to a surrounding area to said facial opening, is capable of exerting pressure of facial integration over the inner surrounding area and said traction arrangement acts as from the influence exerted by a rear convergent arrangement, to which some linepull branches converge that connect the linepull connections with the rear convergent arrangement.

7. The salvage suit according to claim 6, wherein the converging arrangement and the traction arrangement are mounted in the inner part of the outer headpiece cover of the suit acting over the hood through the connection between said hood and said headpiece cover.

8. The salvage suit according to claim 6, wherein:

the traction arrangement includes fixed linepull connections that, placed in a middle area between the facial opening and the rear area of the outer cover, are capable of exercising stretching over the surrounding area of said facial opening and said traction arrangement acts as from the influence exercised by the stretching strips that, from the rear convergent arrangement, connect, at least, part of said fixed linepulls.

9. The salvage suit according to claim 6, wherein:

the traction arrangement includes some anterior-posterior traction strips that, as of the linepull connections of the surrounding area to the facial opening, exercise their action towards the convergent arrangement, said linepull connections include the corresponding linepull connections fixed to said surrounding area of the facial opening and said convergent arrangement includes rear connections through which said traction strips remain under the influence of some stretching strips.

10. The salvage suit according to claim 6, wherein the convergent arrangement includes rear connections, being, at least, part of said rear connections, fixed.

11. The salvage suit according to claim 6, wherein the convergent arrangement includes rear connections in which the stretching strips act.

12. The salvage suit according to claim 6, wherein over the convergent arrangement, the elastic stretching strips act that, through said convergent arrangement, maintain the traction arrangement usually tightened, exercising constant stretching over the traction strips.

13. The salvage suit according to claim 12, wherein the stretching strips are elastic means that, from above front stretching connections, maintain the traction arrangement usually tightened and exercising constant stretching.

14. The salvage suit according to claim 12, wherein is includes stretching strips that have respective front linepulls and front passages through which the respective puling member of each stretching strip emerges.

15. The salvage suit according to claim 14, wherein it includes means of positional lock that, applied to the pulling members of the stretching strips maintain the system adjustment.

16. The salvage suit according to claim 12, wherein the traction arrangement and the convergent arrangement are formed of members of elastic walls that, from the linepull connections in the surrounding area to the facial opening, define some linepull branches that converge in a rear convergent arrangement.

17. The salvage suit according to claim 12, wherein the facial opening is linked to a hermetic structure that seals said facial opening.

18. The salvage suit according to claim 17, wherein the hermetic structure includes a neoprene frame.

19. The salvage suit according to claim 17, wherein the hermetic structure includes a structure frame formed of, at least:

an inner frame of a deformable and non-slip plastic material that, under pressure, is capable of being immovably fixed to the face of the user, an outer frame and an elastic filling that, usually, maintains said hermetic structure expanded.

20. The salvage suit according to claim 17, wherein the hermetic structure is related, on the one hand, to the outer facial opening of the outer headpiece cover and, on the other hand, to the inner facial opening of the inner hood belonging to the wall structure of the suit.

21. The salvage suit according to claim 1, wherein:

at the front part of the body, said structure of insulating walls includes a front protrusion that ends in a transversal access opening of curved edges that constitutes the access opening to the inner receptacle, said transversal access opening, that is arranged with hermetic closing means, separates two adjacent parts, that are functionally movable until reaching the expansion of said access opening and one of the adjacent parts includes a headpiece opening from which the hood is outwardly projected.

22. The salvage suit according to claim 21, wherein the front protrusion forms a tapered or truncated cone initial part from which the walls that form the parts adjacent to the transversal opening of curved edges extend.

23. The salvage suit according to claim 21, wherein the front protrusion is formed by a frame that ends in two parts adjacent to the transversal opening: a thoracic adjacent part and a headpiece adjacent part in which there is a headpiece opening that communicates with a hood.

24. The salvage suit according to claim 21, wherein the thoracic adjacent part is longer than the headpiece adjacent part in such a way that, both parts being separated by the active position of the transversal access opening said thoracic adjacent part is more protruded offering the entering into the inner cavity of the suit, while the headpiece adjacent part is less protruded, but positioned for its closure dumping over the head of the user.

25. The salvage suit according to claim 21, wherein the front protrusion is formed by a piece structured in insulating walls and arranged in such a way that, with the union of the union ends, forms a frame which curved edges define the access opening.

26. The salvage suit according to claim 25, wherein the union ends are oblique in such way that they converge towards the access opening.

27. The salvage suit according to claim 1, wherein the structure of insulating walls includes alveolar aluminized walls with thermal insulation and buoyancy capacity.

28. The salvage suit according to claim 27, wherein the alveolar walls include micro-alveolar walls and macro-alveolar walls.

29. The salvage suit according to claim 27, wherein the structure of insulating walls defines a sectorial differential insulation that is determined by, at least one, of the following factors: the size of the alveolar cells and/or the amount of walls and/or the composition of the walls.

30. The salvage suit according to claim 29, wherein the sectorial differential insulation includes, on the one hand, micro-alveolar walls, with alveoli smaller than 20 mm, in the sectors of the limbs and headpiece, and, on the other hand, macro-alveolar walls, with alveoli equal or bigger than 20 mm, in the rest of the suit.

31. The salvage suit according to claim 29, wherein the structure of insulating walls defines a sectorial differential functionality, including micro-alveolar walls in areas that require more mobility than others.

32. The salvage suit according to claim 1, wherein it includes, at least, a cervical float that, adjacent to the upper opening edge of the outer body cover, is placed behind the hood.

* * * * *